US006345609B1

(12) United States Patent
Djordjevic

(10) Patent No.: US 6,345,609 B1
(45) Date of Patent: Feb. 12, 2002

(54) SUPPLY PUMP FOR GASOLINE COMMON RAIL

(75) Inventor: Ilija Djordjevic, East Granby, CT (US)

(73) Assignee: Stanadyne Automotive Corp., Windsor, CT (US)

( * ) Notice: Subject to any disclaimer, the term of this patent is extended or adjusted under 35 U.S.C. 154(b) by 0 days.

(21) Appl. No.: 09/342,566

(22) Filed: Jun. 29, 1999

Related U.S. Application Data

(63) Continuation-in-part of application No. 09/031,859, filed on Feb. 27, 1998, now abandoned.

(51) Int. Cl.[7] ..... F02M 37/04
(52) U.S. Cl. ..... 123/509; 123/456; 417/273
(58) Field of Search ..... 123/497, 499, 123/456, 509, 446, 516; 417/499, 490, 273, 366, 545

(56) References Cited

U.S. PATENT DOCUMENTS

| | | | | | |
|---|---|---|---|---|---|
| 2,040,390 | A | | 5/1936 | Loe | 73/30 |
| 2,657,634 | A | | 11/1953 | Greenland et al. | 103/38 |
| 3,486,454 | A | | 12/1969 | Tuzson | 103/38 |
| 3,578,879 | A | | 5/1971 | Long et al. | 417/62 |
| 3,682,572 | A | | 8/1972 | Yarger | 417/273 |
| 3,759,637 | A | | 9/1973 | Vuaille | 417/499 |
| 4,141,328 | A | | 2/1979 | Tipton et al. | 123/138 |
| RE32,373 | E | | 3/1987 | Bobier | 91/506 |
| 5,035,221 | A | * | 7/1991 | Martin | 123/451 |
| 5,071,324 | A | | 12/1991 | Ishimoto | 417/490 |
| 5,078,113 | A | * | 1/1992 | Haag et al. | 123/450 |
| 5,213,482 | A | | 5/1993 | Reinartz et al. | 417/273 |
| 5,311,850 | A | * | 5/1994 | Martin | 123/456 |
| 5,511,959 | A | * | 4/1996 | Tojo et al. | 418/55.1 |
| 5,630,708 | A | | 5/1997 | Kushida et al. | 417/273 |
| 5,775,304 | A | * | 7/1998 | Kono et al. | 123/497 |
| 5,848,879 | A | * | 12/1998 | Hansson | 417/521 |
| 5,876,186 | A | | 3/1999 | Stiefel | 417/273 |

FOREIGN PATENT DOCUMENTS

| | | | |
|---|---|---|---|
| DE | 196 27 757 A | 1/1998 | F04B/1/04 |
| DE | 196 50 246 A | 6/1998 | F02M/39/00 |
| DE | 197 26 572 A | 12/1998 | F04B/1/04 |
| EP | 0 851 120 A | 7/1998 | F04B/1/04 |

OTHER PUBLICATIONS

International Search Report—Jun. 30, 1999—PCT/US99/09830.

* cited by examiner

*Primary Examiner*—Carl S. Miller
(74) *Attorney, Agent, or Firm*—Alix, Yale & Ristas, LLP

(57) ABSTRACT

The pumping plungers are actuated radially outwardly and withdraw inwardly by an eccentric rotated by the pump drive shaft and associated captured sliding shoes. Because the shoes are forced to follow the eccentric over the full 360° of rotation, the shoes themselves can play an integral role for implementing the function of an inlet check valve which controls flow through a charging passage in each plunger in a radial outward direction, to a respective plunger pumping chamber. Relatively low pressure fuel in the pump cavity surrounding the drive member, is drawn through openings in the radially inner end of the plunger, through an inlet passageway in the plunger, and into the pumping chamber. The path which low pressure fuel follows from the cavity into the inlet passageway of the plunger, can be implemented in a variety of ways, including direct flow from a radially inner side wall of the plunger into the central inlet passageway; flow through a slot in the drive member which registers with a hole in each shoe and which in turn is in fluid communication with the inlet passageway in the plunger; or the retention of the shoes against the drive member can permit slight separation between a shoe and the drive member momentarily, to allow low pressure fuel to enter a hole in the foot of the shoe, which in turn is in fluid communication with the inlet passageway in the plunger.

39 Claims, 21 Drawing Sheets

SUPPLY PUMP FOR GASOLINE COMMON RAIL

RELATED APPLICATION

This application is a continuation-in-part of application Ser. No. 09/031,859 filed Feb. 27, 1998 abandoned for "Supply Pump for Gasoline Common Rail".

BACKGROUND OF THE INVENTION

The present invention relates to a supply pump for fuel injection into an internal combustion engine, and more particularly, to a supply pump for maintaining high pressure in a common rail fuel injection system.

Direct gasoline injection has some distinct advantages regarding emissions and fuel economy mainly because it allows increased compression ratio of the engine (directly affecting the efficiency of the thermal cycle) without however requiring high octane (leaded) gasoline.

Many passenger car manufacturers are currently trying to develop such systems but one of the main obstacles is unavailability of a reliable and inexpensive pump capable of generating relatively high pressure. High pressure supply pumps currently under industry development for diesel common rail applications, could theoretically be easily modified for use in gasoline direct injection common rail systems. However, inherent to its design, such a pump would have some serious drawbacks because of all the compromises which would have to be made.

In order to prevent formation of vapor cavities in the pump housing (especially in the cam box), to handle variations in fuel quality (winter fuel) and to operate under any imaginable conditions (temperature and altitude), the pump housing must be always pressurized to at least about 2 bar.

The (electric) feed pump must be located either in the tank itself or in close proximity. On a hot summer day and with only partially filled tank (faster fuel recirculation), the fuel temperature in the tank can reach estimated levels of up to 140° F. Because of low gasoline vapor pressure, the feed pump must be installed below the lowest expected fuel level in the tank, in order to ensure so called positive suction height.

Typical electric feed pumps used with conventional low pressure, mostly called indirect or also manifold gasoline injection, usually operate in the pressure range of about 3–4 bar. Such feed pressure is insufficient for use in a diesel supply pump adapted for gasoline pumping.

Considering the short charging duration of an intermittently operating cam and the higher speed range of gasoline engines, the absence of retraction assisted plunger/shoe/roller assembly motion reversal, and also the necessity to overcome the required higher housing pressure, the minimum pressure the feed pump must generate would have to be well above 7 bar, which is more or less the pressure limit of a typical fuel filter.

Because of a fire hazard danger in the case of even a small gasoline leak, all dynamic and stationary seals would have to be modified to ensure proper sealing of the higher pressure, and every seal would also have to be backed up by another redundant seal. This would lead to a substantial increase of overall dimensions of a diesel pump, which is already too big for the typically smaller gasoline engines.

At 120 bar pressure level the amount of the fuel stored in the rail by compressibility of fuel only and available for injection would be minimal. In order to maintain more or less constant rail pressure required for operation of an open loop controlled injector, either greater accumulator volume or some kind of accumulator assistance, would be necessary. However, the resulting lower "spring rate" of the accumulator would require further increase of the pump capacity in order to ensure satisfactory system dynamics (whether for an inlet metered or a waste gate controlled pump), resulting in many additional potential problems such as supply line diameter increase; larger capacity of the fuel filter; larger feed pump capacity (with parasitic power and heat dissipation); and control valve (dump or inlet metering) size and its electric requirements.

SUMMARY OF THE INVENTION

It is, accordingly, an object of the present invention to provide a high pressure common rail fuel supply pump, that is optimized for gasoline injection. In particular, it is an object to provide such a fuel supply pump, in conjunction with a conventional electric gasoline feed pump.

It is another object to provide such a gasoline supply pump, which is resistant to the formation of vapor cavities.

It is further object of the invention to provide such a high pressure supply pump which can maintain a constant rail pressure during the full rotation of the pump drive shaft, thereby facilitating direct open loop injector control.

It is yet another object of the invention, to provide a method of operating a common rail gasoline fuel injection system for a multi-cylinder internal combustion engine, in which direct open loop injector control is achieved without a high pressure accumulator external to the pump.

It is yet another object, to provide a high pressure gasoline fuel supply pump which is compact and produces low hydraulic noise.

A still further object is to provide a gasoline fuel supply pump in which variable rail pressure is achieved by a servo dump valve controlled by a proportional valve.

Another object is to provide a high pressure gasoline supply pump, in which a very efficient sealing arrangement prevents leakage from a very compact pump housing.

Yet another object is to provide a gasoline supply pump which can be mounted directly on a fuel tank so as to draw a fuel feed flow from the tank without the need for a distinct feed pump.

A further object of the invention is to provide a plunger plug for mounting in the housing to receive and guide a reciprocating plunger, which is easy to manufacture and install.

According to one fundamental aspect of the present invention, individual pumping plunger bores and associated pumping chambers are equi-angularly spaced and radially mounted in a pump housing. The pumping plungers are actuated radially outwardly and withdraw inwardly by an eccentric rotated by the pump drive shaft and associated captured sliding shoes. Because the shoes are forced to follow the eccentric over the full 360° of rotation, the shoes themselves can play an integral role for implementing the function of an inlet check valve which controls flow through a charging passage in each plunger in a radial outward direction, to a respective plunger pumping chamber. During the radially inward movement of each plunger, whereby the plunger is drawn by the drive member and shoe toward the center of the pump, a vacuum is drawn at the pumping chamber. Relatively low pressure fuel in the pump cavity surrounding the drive member, is drawn through openings in the radially inner end of the plunger, through an inlet passageway in the plunger, and into the pumping chamber.

The path which low pressure fuel follows from the cavity into the inlet passageway of the plunger, can be implemented in a variety of ways, including direct flow from a radially inner side wall of the plunger into the central inlet passageway; flow through a slot in the drive member which registers with a hole in each shoe and which in turn is in fluid communication with the inlet passageway in the plunger; or the retention of the shoes against the drive member can permit slight separation between a shoe and the drive member momentarily, to allow low pressure fuel to enter a hole in the foot of the shoe, which in turn is in fluid communication with the inlet passageway in the plunger. A common rail is preferably situated within the housing and fluidly connected to all the discharge passages from the pumping chambers, downstream of the discharged check valves.

Another aspect of the present invention, involves various arrangements for establishing a seal between the drive shaft and the cavity at feed pressure, from which fuel is drawn into the pumping chamber, to prevent leakage of fuel along the drive shaft and therefore from the pump housing. This is achieved in various embodiments, by having either a plurality of seal chambers in which the outermost chamber has a fluid connection to, e.g., the fuel tank, or in another embodiment, by providing a virtual seal at a thrust plate forming a boundary of the cavity, such that an adjacent seal chamber will be maintained at low pressure for connection to the fuel return line to the fuel tank.

In another aspect of the invention, a novel plunger plug arrangement is secured to the pump body, for providing the plunger bore, mounting the discharge check valve, and establishing a discharge passage, utilizing only two unitary components, each of which can be machined fully during one chuck set-up.

In yet another aspect of the invention, the high pressure gasoline fuel supply pump housing, particularly the body, also forms the housing for an electric motor unit, whereby the pump and motor unit can be mounted at the fuel tank. This takes advantage of the ability of the pump to draw fuel from the pump cavity through the plunger into the pumping chamber directly, or virtually directly, from the fuel tank, in some cases without the need for a primary or feed pump.

BRIEF DESCRIPTION OF THE DRAWINGS

These and other objects and advantages of the invention will be explained in greater detail with reference to the accompanying drawings, in which.

DESCRIPTION OF THE PREFERRED EMBODIMENT

Figure 1:
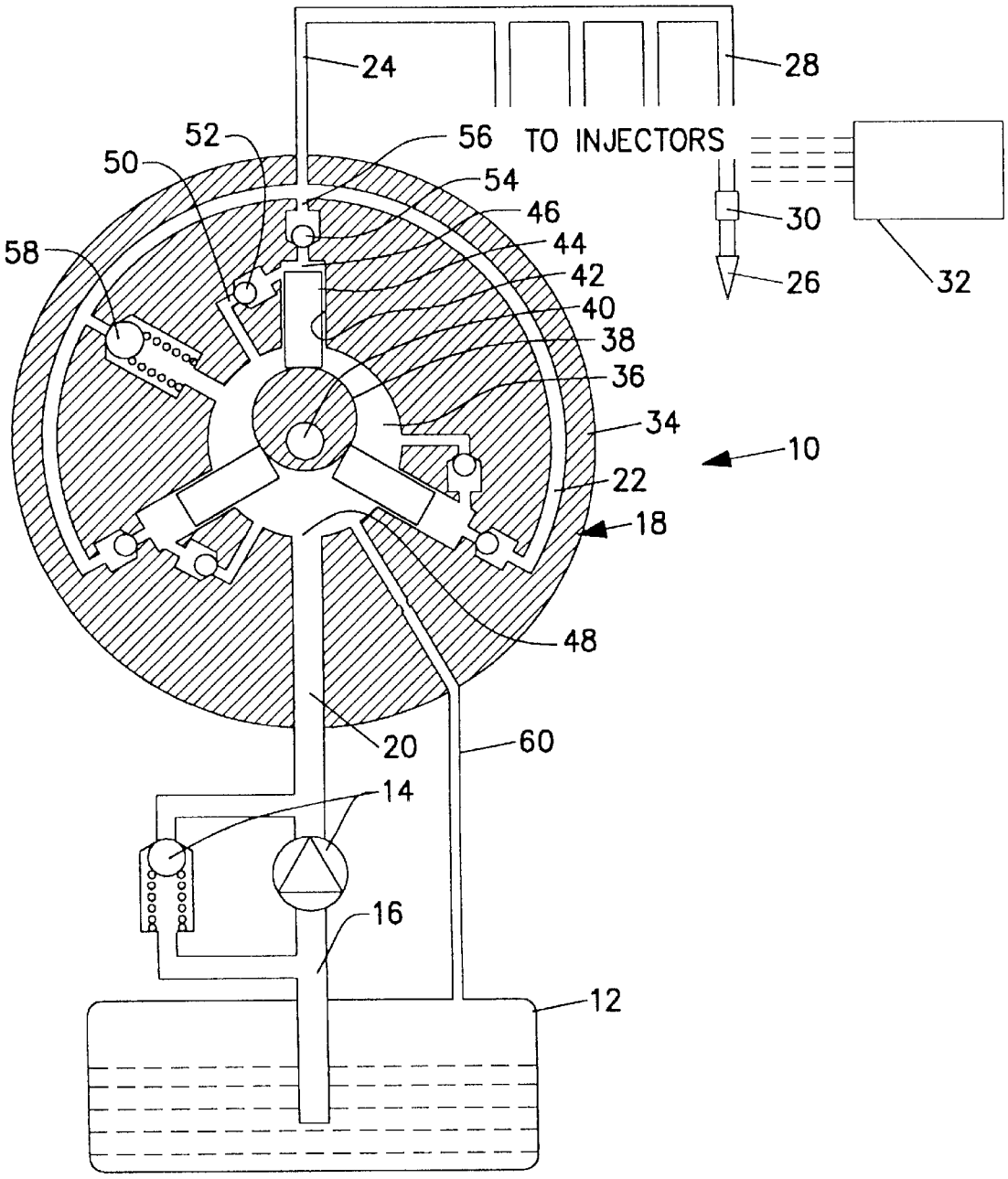
FIG. 1 is a schematic representation of the gasoline supply pump in accordance with the present invention.

FIG. 1 is a schematic of a gasoline fuel injection system 10, comprising a fuel tank 12, a low pressure feed pump 14 with associated pressure regulator, for delivering fuel via low pressure fuel line or suction line 16, to the high pressure fuel supply pump at a feed pressure in the range of 2–5 bar, preferably in the range of 3–4 bar. This feed pump 14, can be a conventional electrical pump. The fuel from the feed pump 14 enters supply pump 18 through a feed passage 20, where the fuel pressure is increased to a value in excess of 100 bar, which is sustained in the common rail 22 internal to the pump. That rail pressure is imposed on the external common rail 24 for delivery to a plurality of fuel injectors 26, each of which is fed by a fuel injector branch line 28 and controlled by associated injector control valve 30. The injector control valves 30 are controlled by the injector controller 32, which in turn is under the control of the electronic control unit for the engine (not shown). Each of the injectors 26 is associated with one cylinder of a multi-cylinder internal combustion engine, in a manner well known in this field.

The high pressure supply pump 18 is constituted by a pump housing 34 and an internal cavity 36, to which the low pressure fuel is supplied via feed passage 20. It should be appreciated that the cavity is filled with fuel at the feed pressure of at least 2 bar. An eccentric drive member 38 is rotatable within the cavity 36, around pilot shaft 40, for increasing the fuel pressure to the internal common rail 22, in the following manner. A plurality of plunger bores 42 extend radially from the cavity, typically equi-angularly. A pumping plunger 44 is situated in a respective bore 42, for reciprocal radial movement therein as a result of the eccentric rotation of the drive member 38. A pumping chamber 46 is formed at the radially outer end of each plunger 44. Fuel at feed pressure enters the cavity through cavity inlet port 48. As this fuel fills the cavity 36, it likewise fills the respective charging passages 50, which are normally closed by the charging check valve 52. In a manner to be described more fully below, the plungers 44 are actuated by means of captured sliding shoes, which are forced to follow the eccentric over 360° of rotation. In a significant aspect of the present invention, the shoes themselves can perform the function of an inlet check valve. It can be appreciated that if each plunger 44 is drawn radially inwardly while in contact with the drive member 38, the pressure in the pumping chamber 46 will be reduced, thereby opening the charging check valve 52, whereby fuel at the cavity pressure is delivered to the pumping chamber 46. Thereafter, as the plunger 44 is urged radially outwardly by the rotation of the drive member 38, the fuel in the pumping chamber 46 undergoes high pressure thereby opening the discharge check valve 54 and flowing through the discharge passage 56 into the internal common rail 22.

It can be appreciated that throughout this cycle for each pumping chamber 46, the minimum pressure anywhere within the housing is preferably in the range of 3–4 bar psi, without any voids which would induce vaporization.

A rail pressure regulator 58 can be interposed within the housing, between the internal common rail 22 and the cavity 36, to assure that the rail pressure does not exceed a predetermined limit value.

Optionally, a low pressure fuel recirculation line 60 can be provided between the cavity 36 and the fuel tank 12 to dissipate some of the heat generated by the pump.

Figure 2:
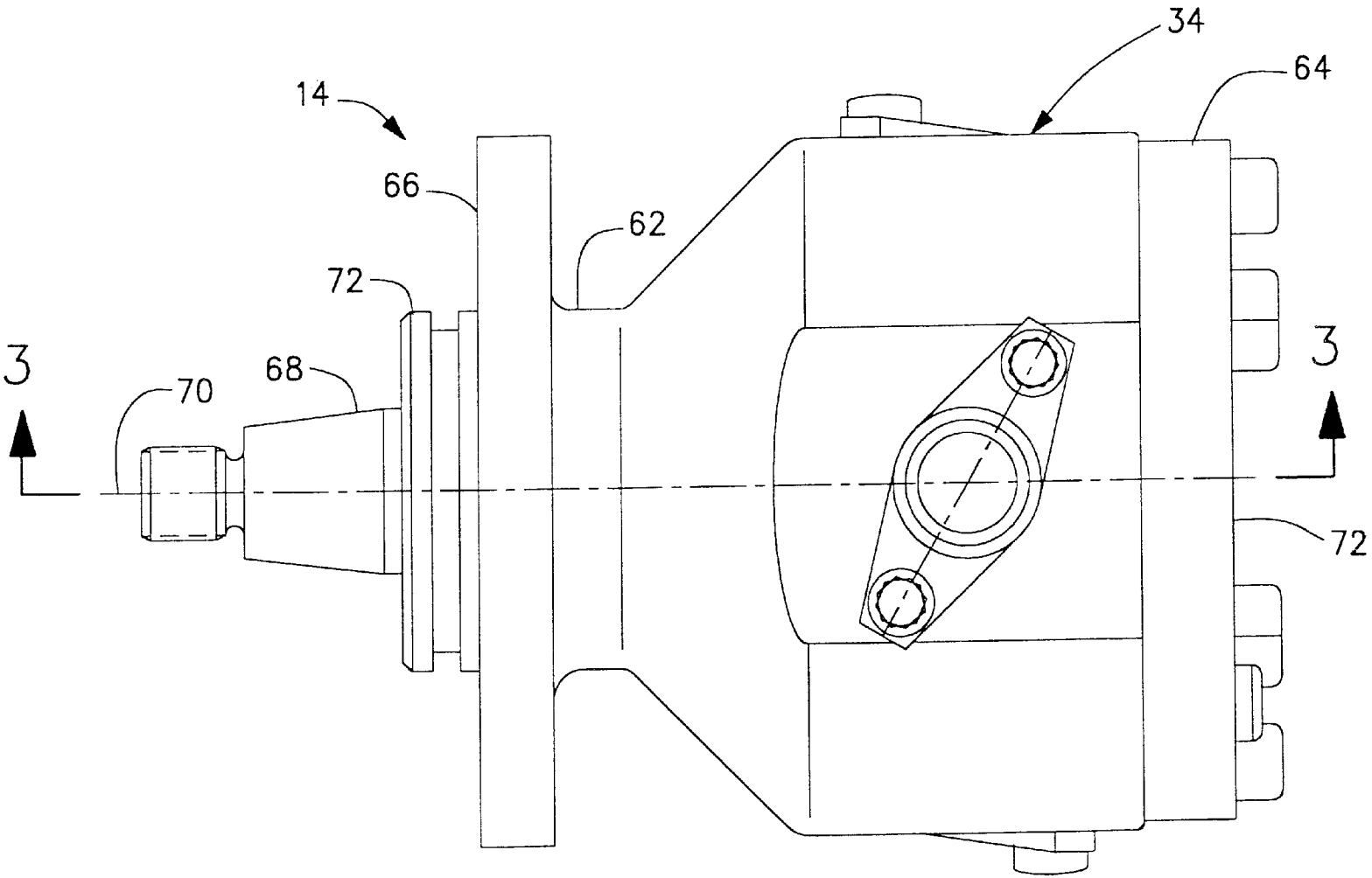
FIG. 2 is a top view of a first embodiment of a supply pump in accordance with a first embodiment of the invention.
Figure 3:
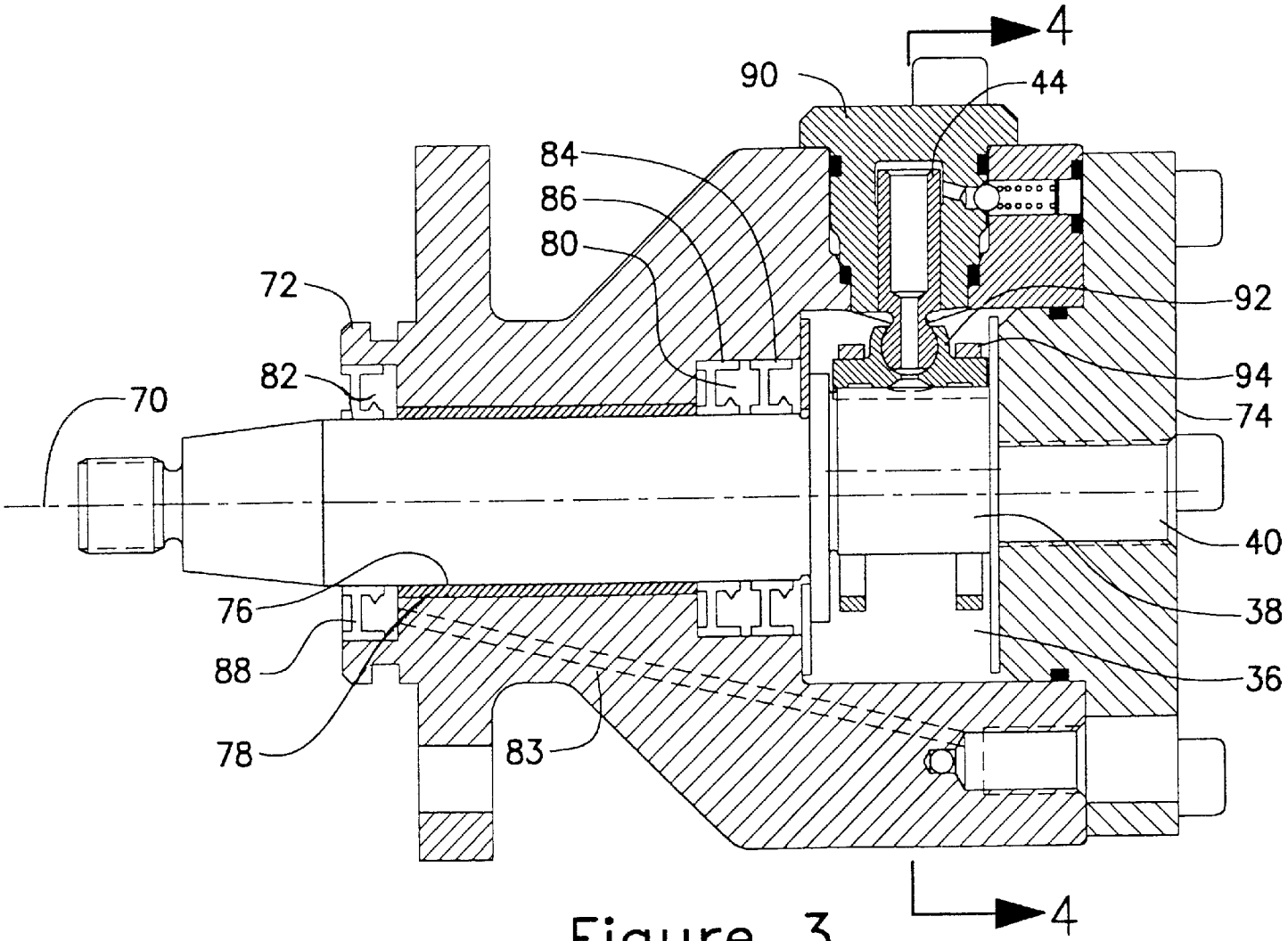
FIG. 3 is a longitudinal section view, taken along line 3—3 of FIG. 2.

FIGS. 2–9 show a first implementing embodiment of the invention as shown schematically in FIG. 1. With particular reference to FIGS. 2 and 3, the fuel supply pump 18 has a body 62 and a detachable cover 64. The body at the end opposite the cover, forms a flange 66 for connection to the engine. The drive shaft 68 for the pump is actuated directly or indirectly by the engine, in a manner well known in this field of technology. The drive shaft 68 rotates about a longitudinal axis 70 of the pump 14. The pump housing 34 can be considered for present purposes, as constituting the combination of the pump body 62, pump cover 64 and components integral therewith, whereby a housing back end 72 and a housing front end 74 can be identified. The pump body 62 includes a drive shaft bore 76 which extends coaxially from the back end of the housing to the cavity 36. The rotatable drive shaft 68 is coaxially situated in the drive shaft bore 76, journalled therein by a semi-wet bushing 78 having front and back ends. The drive shaft is rigidly connected (preferably integrally) to the eccentric drive member 38, in the cavity 36. The drive shaft bore 76 includes a front seal chamber 80 interposed between and in fluid communication with the cavity 36 and the front end of the bushing 78, and a back seal chamber 82 interposed between and in fluid communication with the back end of the bushing 78 and an ambient pressure condition. First and second front seals 84,86, are situated in the front seal chamber 80 for sealing against flow of fuel in the cavity 36, through the drive shaft bore 76. Also, a low pressure back seal 88 is situated in the back seal chamber 82, for preventing any fuel flow which might leak through the high pressure seal and through the semi-wet bushing bore to the back end of the bushing, from leaking out of the back of the housing. The front seal means 84,86 should be sufficient to prevent leakage of fuel out of the housing. Nevertheless, in the event of leakage through the semi-wet bushing 78, the third back-up seal not only provides a physical barrier to leakage, but it is never exposed to high pressure because its bushing side is always vented preferably through a low pressure return line 83, to the fuel tank.

With further reference now to FIGS. 3–6, one embodiment for the interaction between the pumping plungers 44 will be described in detail. It should be understood that, typically, the plunger would be disposed in a removable plunger plug 90 which penetrates the housing body 62. For purposes of the present description, however, it can be assumed that the plunger plug 90 is integral with and therefore a part of, the pump housing 34. Each plunger 44 is connected, preferably pivotally, to a cam shoe 92, and retention means, such as the energizing ring 94, urge the shoes 92 against the external profile of the eccentric drive member 38.

Figure 5:
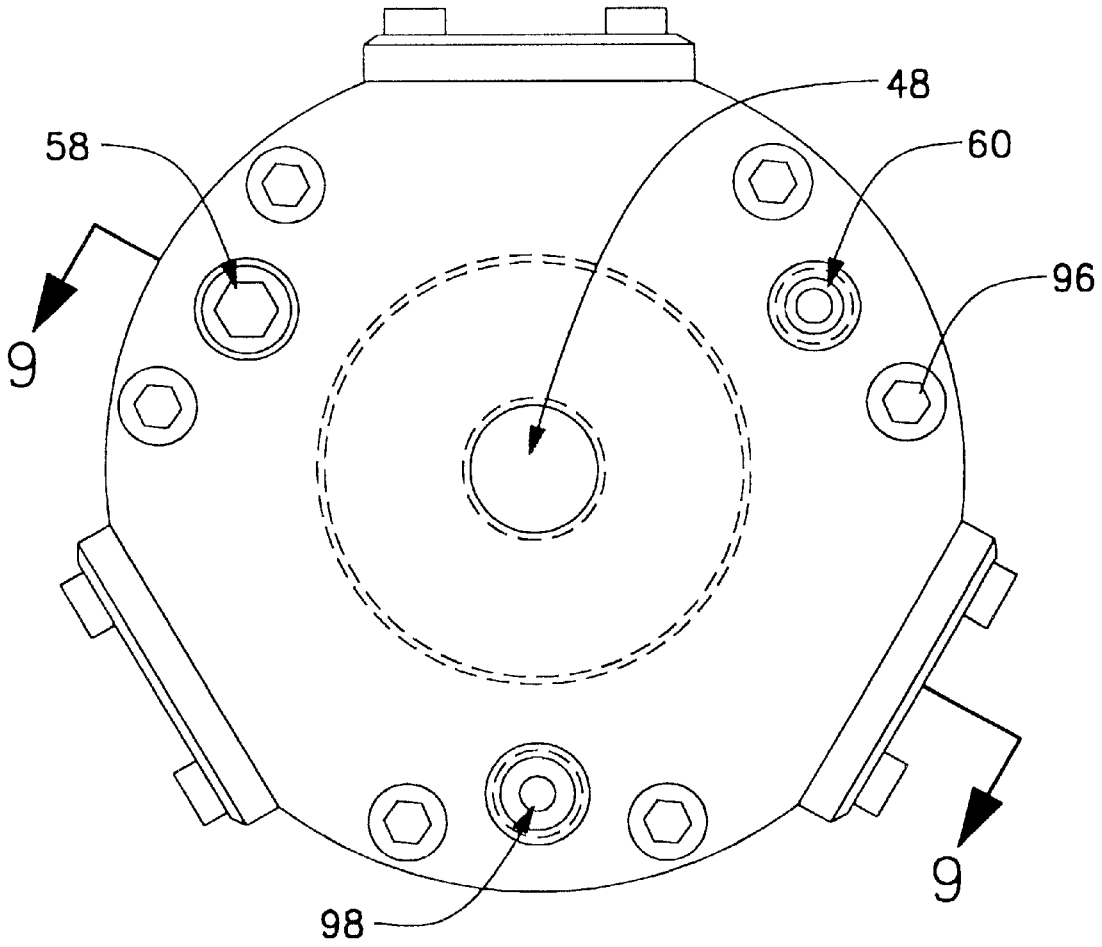
FIG. 5 is an end view of the pump shown in FIG. 2, from the right.

When the assembled pump 18 is viewed from the front end 74, for example as indicated in FIG. 5, six cover bolts 96 may be seen, as well as the high pressure connection 98 for the external rail (not shown), the plug containing the rail pressure limiter 58, and the connector for the optional low pressure recirculation line 60. In this embodiment, the connection for the feed inlet port 48, is centered on the longitudinal axis 70.

Figure 4:
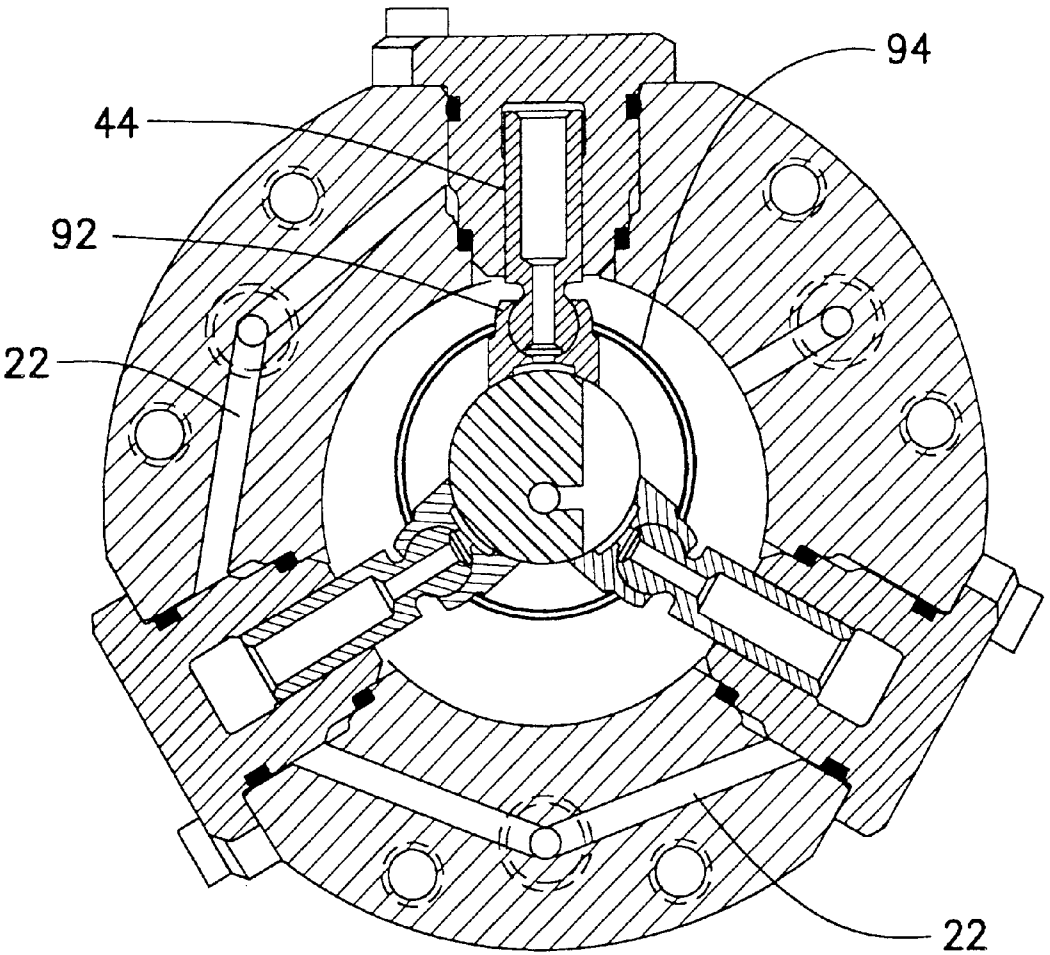
FIG. 4 is a cross-section view, taken along lines 4—4 of FIG. 3.
Figure 6:
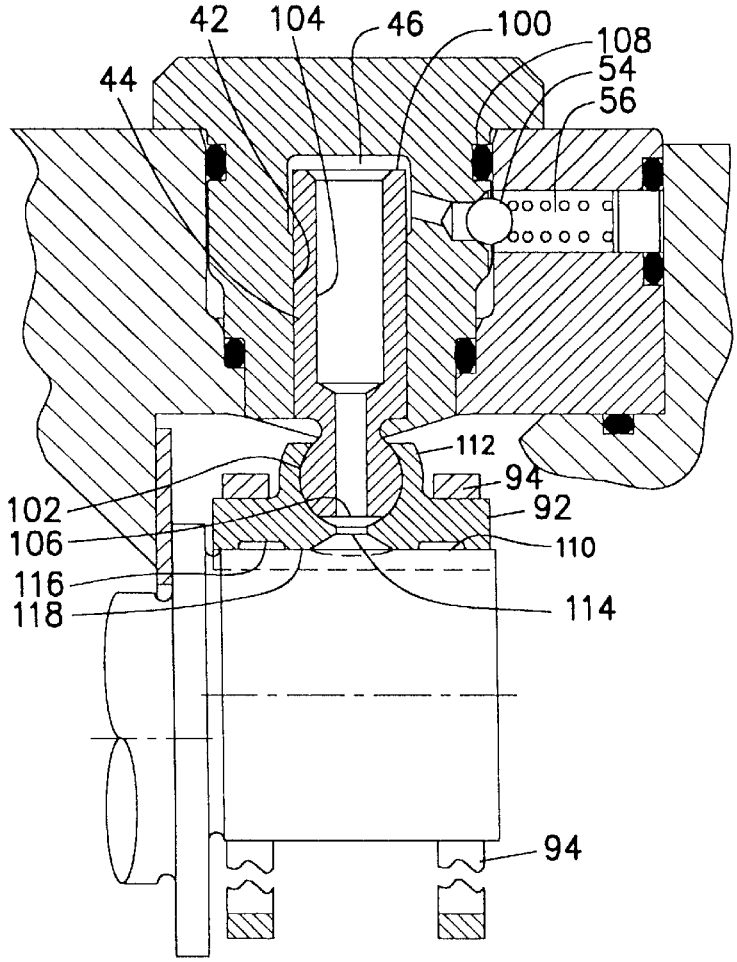
FIG. 6 is a detailed view of the pumping plunger and associated drive member, shown in FIG. 3.

With reference in particular to FIGS. 4 and 6, the first embodiment for the fuel charging arrangement will be described in further detail. Each plunger 44 has an outer end 100 and an inner end 102. The term "end" as used herein, should be understood as meaning that portion of the member at a terminus, or situated closer to the terminus than to the center of the member. A charging passage 104, extends substantially coaxially through the plunger 44, although the cross sectional area need not be uniform. The plunger inner end 102 is preferably formed with a substantially spherical shape, to fit into a cradle 112 or the like extending from the shoe 92. The radially inner end 102 of the plunger has an inner opening 106 for charging passage 104, which registers with a shoe bore 114. A substantially circular energizing ring is wrapped around each shoe 92 on either side of the cradle 112, thereby urging all the shoes 92 against the external profile 110 of the eccentric drive member 38.

As the drive member 38 rotates eccentrically, each plunger 44 is, in sequence, reciprocated toward an inner limit position, which induces a low pressure in the pumping chamber 46 in the outer end of the plunger bore 42, and an outer limit position for developing a high pressure in the pumping chamber. In a somewhat conventional manner, the highly pressurized fuel in the pumping chamber 46 is discharged through discharge check valve 54, into the discharge passage 56 which, in turn, fluidly communicates with the internal common rail 22 toward the front of pump body 62.

Figure 7:
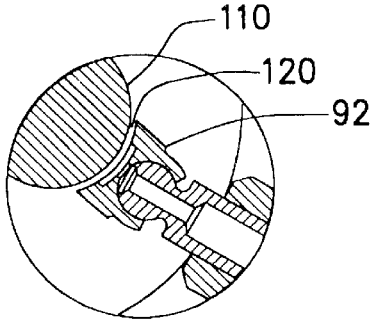
FIG. 7 is a detailed view of the pivotal connection between the pumping plunger and the drive shoe shown in FIG. 6, at a point in time when the shoe has momentarily separated from the drive member to permit low pressure fuel into the inlet passage for delivery to the plunger pumping chamber of FIG. 6.

In a noteworthy aspect of the present invention, the plunger 44 and associated shoe 92, perform the function of the charging passage 50 and charging check valve 52 shown in the schematic of FIG. 1. It can be appreciated that if the size and resiliency of the shoe retaining rings 94 and appropriately selected, a slight and momentary gap or space can be produced as the drive member continues to rotate from the point at which the plunger 44 is at its radially outer limit position. This condition is represented in FIG. 7, where lift space 120 is revealed between the external profile 110 of the drive member, and the arcuate sliding surface of the shoe 92. The simultaneous condition of low pressure created in the pumping chamber 46 during radially inward movement of the piston 44 due to the "no backlash" connection with the shoe 92, and the exposure of the shoe bore 114, and thus the charging passage 104 to the fuel at feed pressure in the cavity, produces a charging flow into the pumping chamber 44. This flow can be enhanced by providing channels 116 in the sliding surface of the shoe 92. In essence, these channels act as accumulators of fuel during that portion of the rotation cycle of the drive member 56, during which the shoe closely follows, and therefore is sealed against, the external profile 110. The maximum sealing contact occurs at the inner footprint 118, against the external profile 110.

Figure 8:
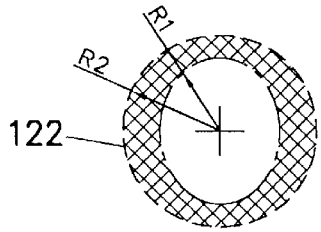
FIG. 8 is a schematic representation of the unbalanced area between the shoe and the drive member, at the moment of maximum shoe load and bearing load.

This contact is represented in FIG. 8 where the load surface 122 is shown with cross-hatching. In FIG. 8, the radius $R_1$ corresponds to the inlet port for the shoe bore and the larger radius $R_2$ corresponds to the outer diameter of the plunger. By selecting these radii such that corresponding areas and thus the respective forces reduce the shoe load but not enough to lift off undesirably, the shoe load against the drive member can be maintained at a satisfactory level that produces acceptable torque loads on the shaft and side loads or plunger resulting in reduced wear on all components.

Figure 9:
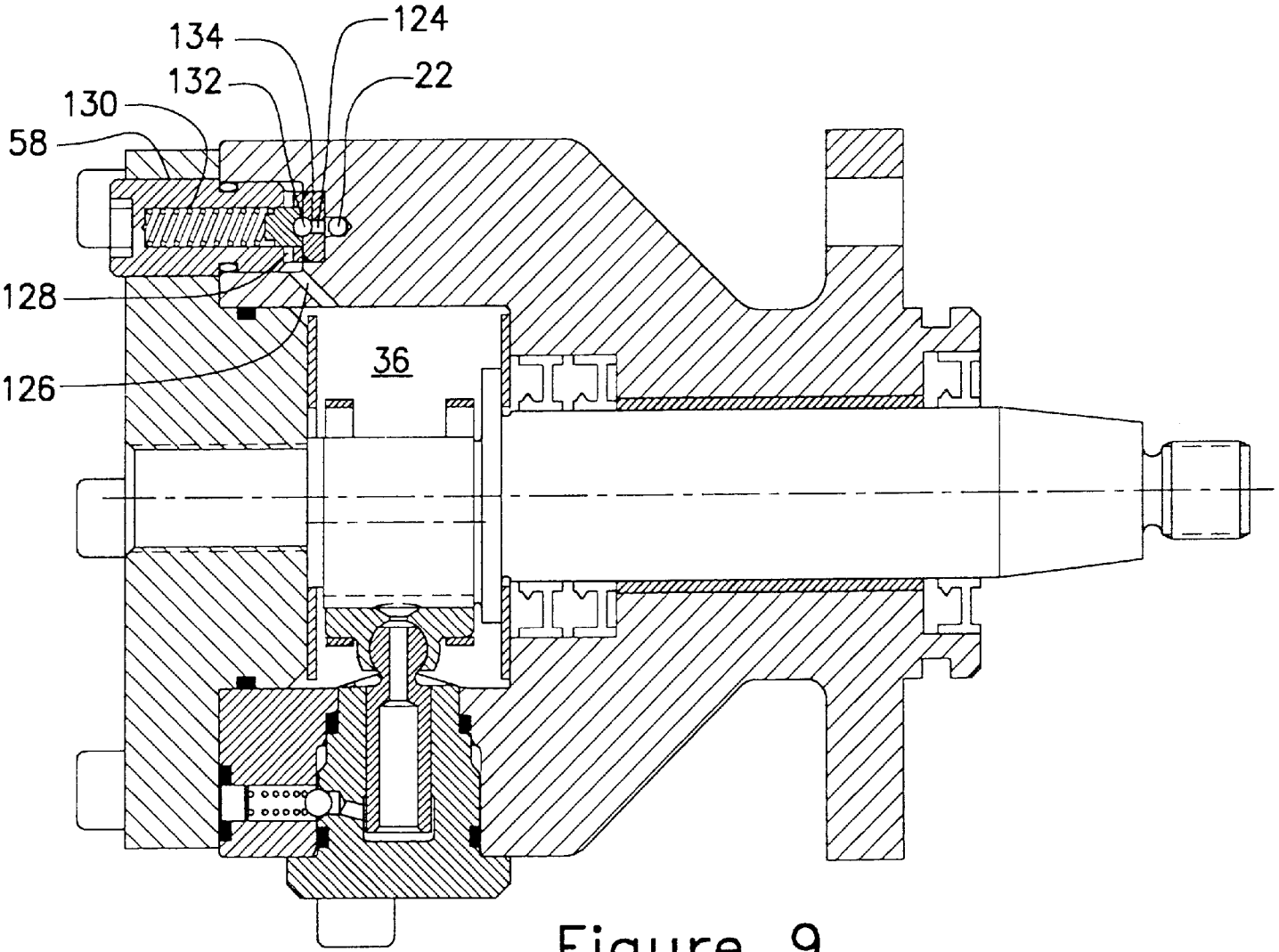
FIG. 9 is a longitudinal section view, taken along line 9—9 of FIG. 5.

In another aspect of the pump, as shown in FIG. 9, a rail pressure regulator is situated at least in part in the cover 64, and in part in the body 62. In the embodiment shown in FIG. 9, the regulator 58 has a high pressure side 124 fluidly connected to the internal rail 22, and a low pressure side 128 connected via passage 126 to the cavity 36. A conventional ball valve member 132 energized by spring 130 against seat 134, can be preset to open at a specified rail limit pressure.

Figure 10:
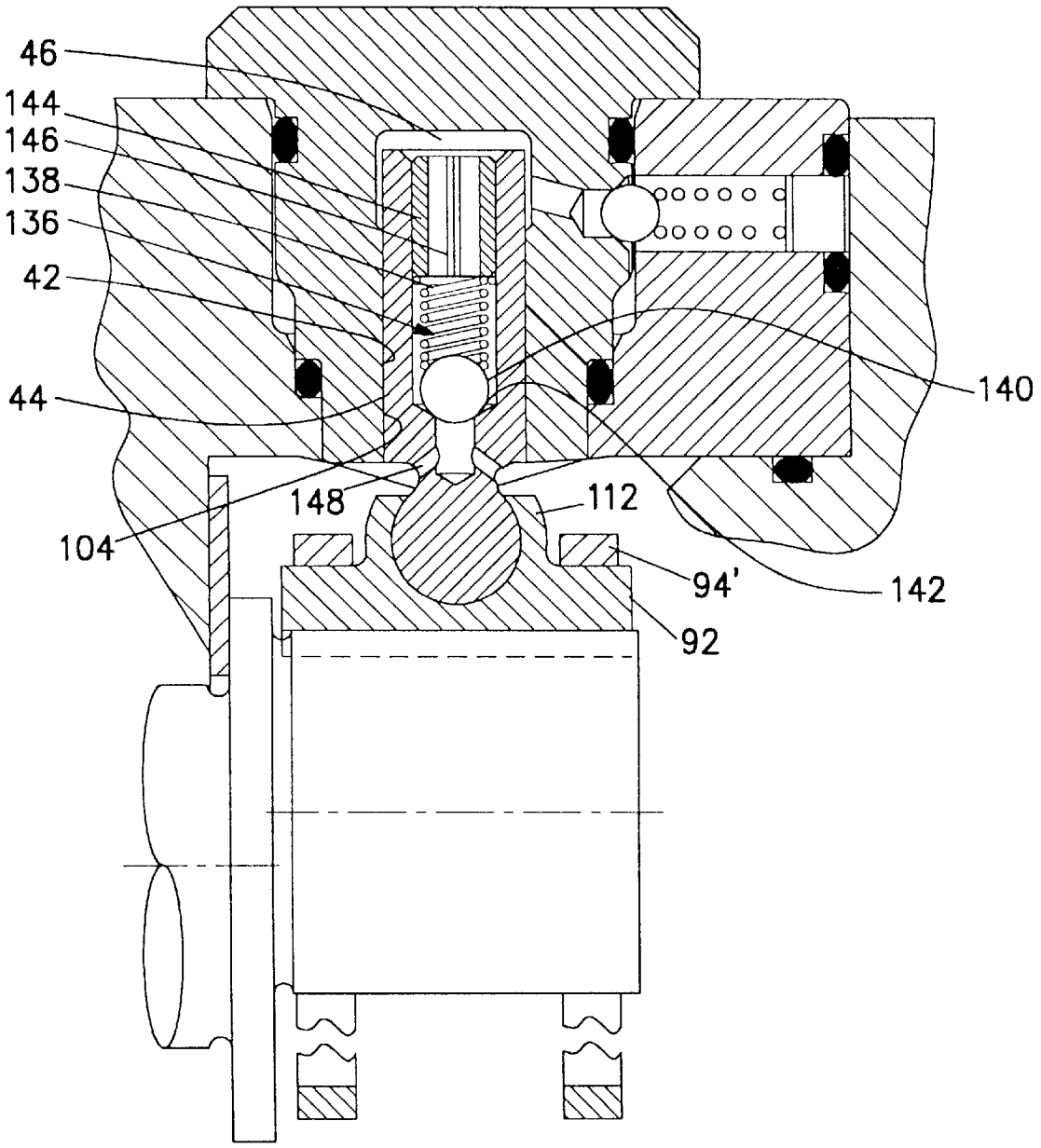
FIG. 10 is a detailed view of a second embodiment of the invention, for delivering low pressure fuel through the inlet passageway of the plunger, to the pumping chamber.

FIG. 10 illustrates a second embodiment of charging through the plunger 44. In this embodiment, the energizing rings 92', which as in the other embodiment, are situated on either side of the shoe cradle 112, urge each of the shoe means against the external profile of the drive member, without the need for momentary separation. In this embodiment, the charging check valve 136 is entirely formed in conjunction with the plunger 44. An energizing spring 138 acts against valve ball 140, to seal against seat 142 during the radially outward movement of plunger 44 for pressurizing the pumping chamber 46. The spring 138 is restrained by holder 144, which has a through bore 146. The charging port 148 is located at the inner end of the plunger 44, between the shoe and the seat 142, so as to be continuously exposed to the fuel in cavity 36. As with the previously described embodiment, as the plunger 44 is pulled radially inwardly by the shoe 92 following the external profile 110 of the drive member, a low pressure is created in the pumping chamber, which draws fuel through charging port 148 and charging check valve 136, which opens as a result of the higher pressure in the cavity relative to the lower pressure in the pumping chamber. In this embodiment, no inlet bore or other special formations or structures are needed on the arcuate sliding surface of the shoe 92. The major advantage of having a small check valve inside the plunger, is bidirectionality of drivability.

Figure 11:
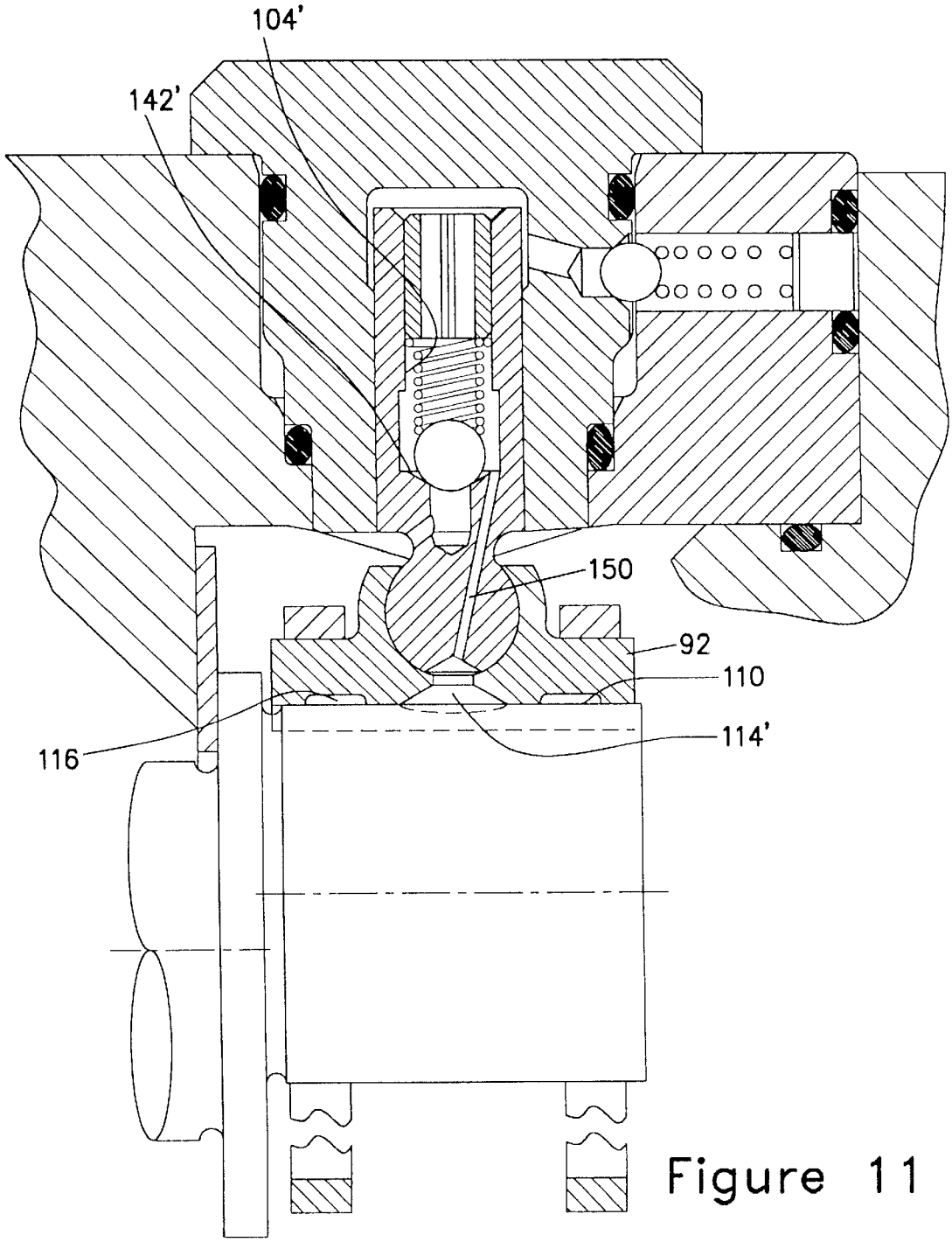
FIG. 11 is a detailed view of a third embodiment for delivering low pressure fuel through the inlet passageway of the plunger, to the pumping chamber.

FIG. 11, shows a third embodiment of the charging check valve, which is similar to that shown in FIG. 10, in that the shoes do not normally separate from the drive member and the charging valve draws fuel from the charging port situated in the plunger, but further including a balance passage 150 extending from the charging passage 104' at a location radially outwardly of valve seat 142', to shoe bore 114' confronting the exterior profile 110 of the drive member. This embodiment also can include the shoe channels 116. The balance passage arrangement shown in FIG. 11, achieves reduction of net normal force and this reduced heat and plunger side loading.

Figure 12:
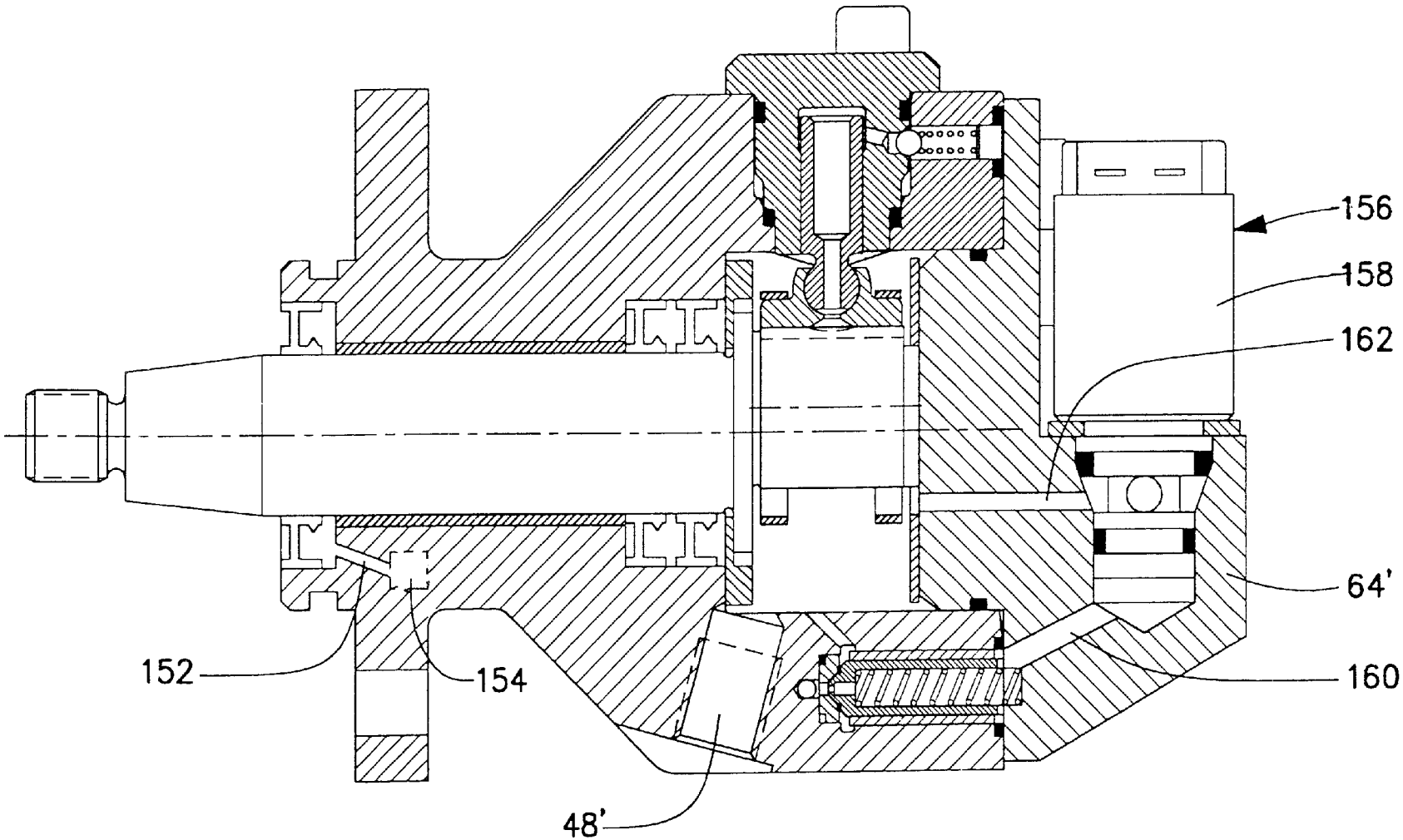
FIG. 12 is a longitudinal section view of a further development of the pump shown in FIG. 3, whereby a variable rail pressure control system is integrated into the cover of the pump housing.
Figure 13:
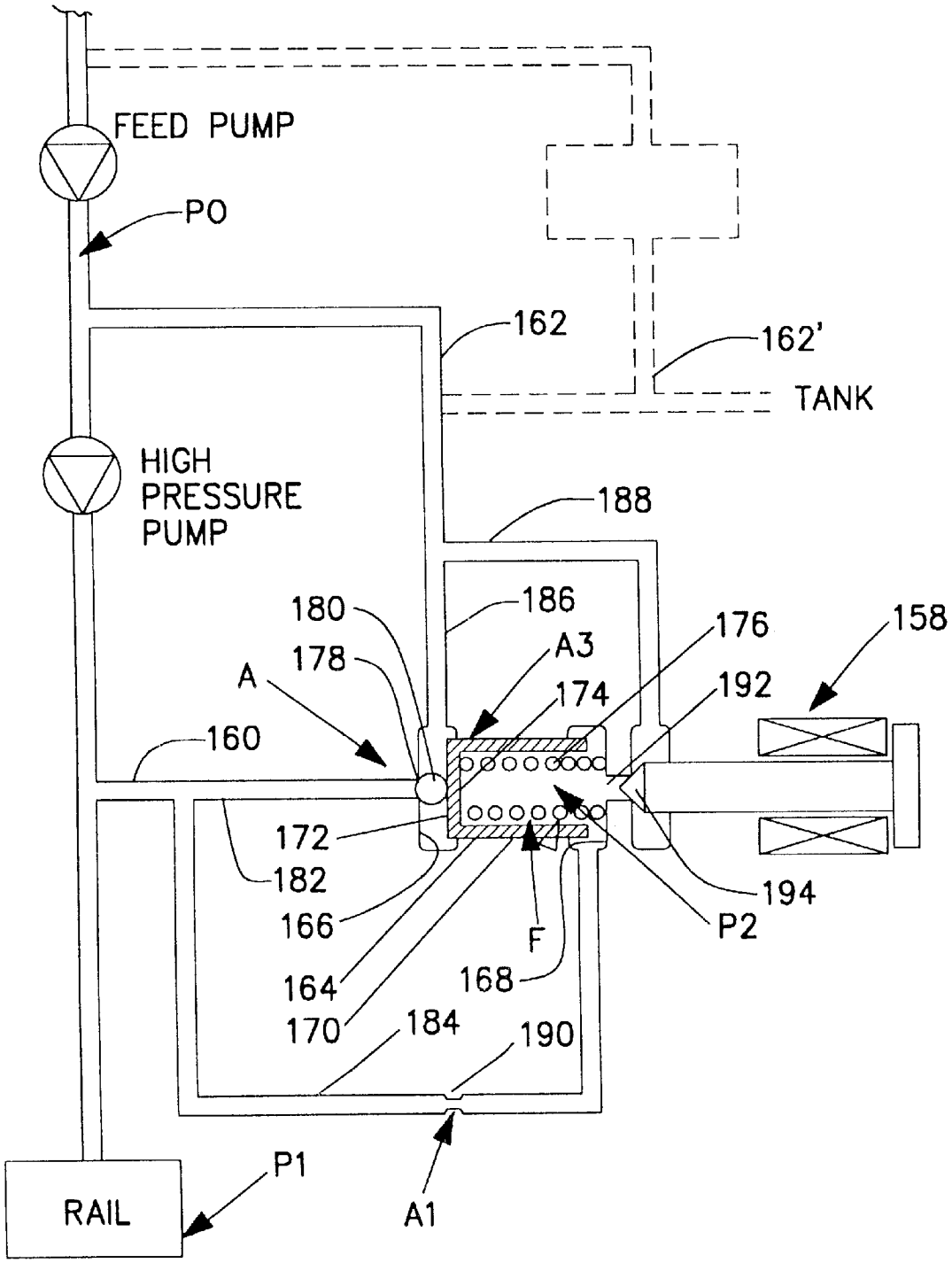
FIG. 13 is a schematic representation of the rail pressure modulation scheme which is implemented according to the development shown in FIG. 12.

FIGS. 12 and 13 show an improved variable rail pressure control feature, which can in large part be incorporated into the modified cover 64'. This pressure modulation feature 156, includes a proportional solenoid valve 158 mounted in cover 64', and a passage 160 from the valve 158 through the cover and in fluid communication with the rail pressure. In addition, another pressure passage 162 extends from the solenoid valve 158 through the cover for fluid communication with the cavity 36. The valving arrangement 156 within the cover 64', is schematically represented in FIG. 13, as including a control piston chamber 164 having a controlled end 166 and a control end 168. A control piston 170 is situated within the control piston chamber 164, with a respective controlled end 172 and control end 174. The control piston 170 is energized by spring 176 to urge valve member 180 against the valve seat 178 at the controlled end of the chamber 164. The rail pressure passage 162 branches into a rail pressure first branch 182, which pressure is imposed on the downstream side of valve member 180, and a rail pressure second branch 184, which is in fluid communication through flow restrictor 190, with the controlled end 174 of the piston. The cavity pressure passage 162 branches into a cavity pressure first branch 186, which is in fluid communication with the controlled end 166 of the chamber 164, in combination with the piston 170, influences the seating load on the valve member 180 against seat 178. A control orifice 192 is in fluid communication with the control end 168 of the piston chamber 164. A control valve member 194 is mounted for modulation of the flow cross section through orifice 192. The cavity pressure second branch 188 from cavity pressure passage 162, is in fluid communication on the upstream side of valve member 194. The control valve member 194 is under the influence of a proportional solenoid so as to constitute a proportional solenoid valve 158, thereby exposing the control end 174 of piston 170, to cavity pressure, through a modulated control valve 158.

It can thus be appreciated that, with reference to the following symbology:

$p_0$=cavity pressure $p_1$=rail pressure $p_2$=fluid pressure imposed on the control end 174 of the piston a=area of passageway 182

$a_1$=area of restriction 190

$a_3$=area of control piston chamber 164 f=spring force acting on the piston 170

By adjusting these parameters, the modulation scheme operates according to customers' requests.

The foregoing modulation scheme is especially adapted for use with a low horse power engine. In a high horse power engine, the relatively low pressure in cavity pressure passage 162 is still higher than desired. Therefore, the passage 162 is replaced (see phantom lines) by tank pressure passage 162', which is fluidly connected to the fuel tank, and therefore is at a lower pressure than the 3–4 bar psi pressure typically maintained in the cavity.

In the embodiment of FIG. 12, it should be appreciated that the cavity inlet port 48' can be relocated relative to the front face position shown in FIG. 5, to a location obliquely through body 62 and the low pressure line or passage 152 from the back seal chamber can be re-routed to a low pressure sink shown in phantom as 154.

Returning now to the initial embodiment disclosed with respect to FIG. 3, in some end use applications, the requirements dictate that the overall longitudinal dimension of the pump be foreshortened. Under such circumstances, the relatively elongated shaft 68 with associated elongated semi wet bushing 78, with associated front and back seal chambers 80,82, cannot readily be implemented. Although one could imagine foreshortening the body 62 and eliminating the back seal chamber 82, so as to achieve the dimensional requirements, the danger of gasoline leakage through the back of the pump and associated risk of fire in the engine compartment, militate against such modification.

Figure 14:
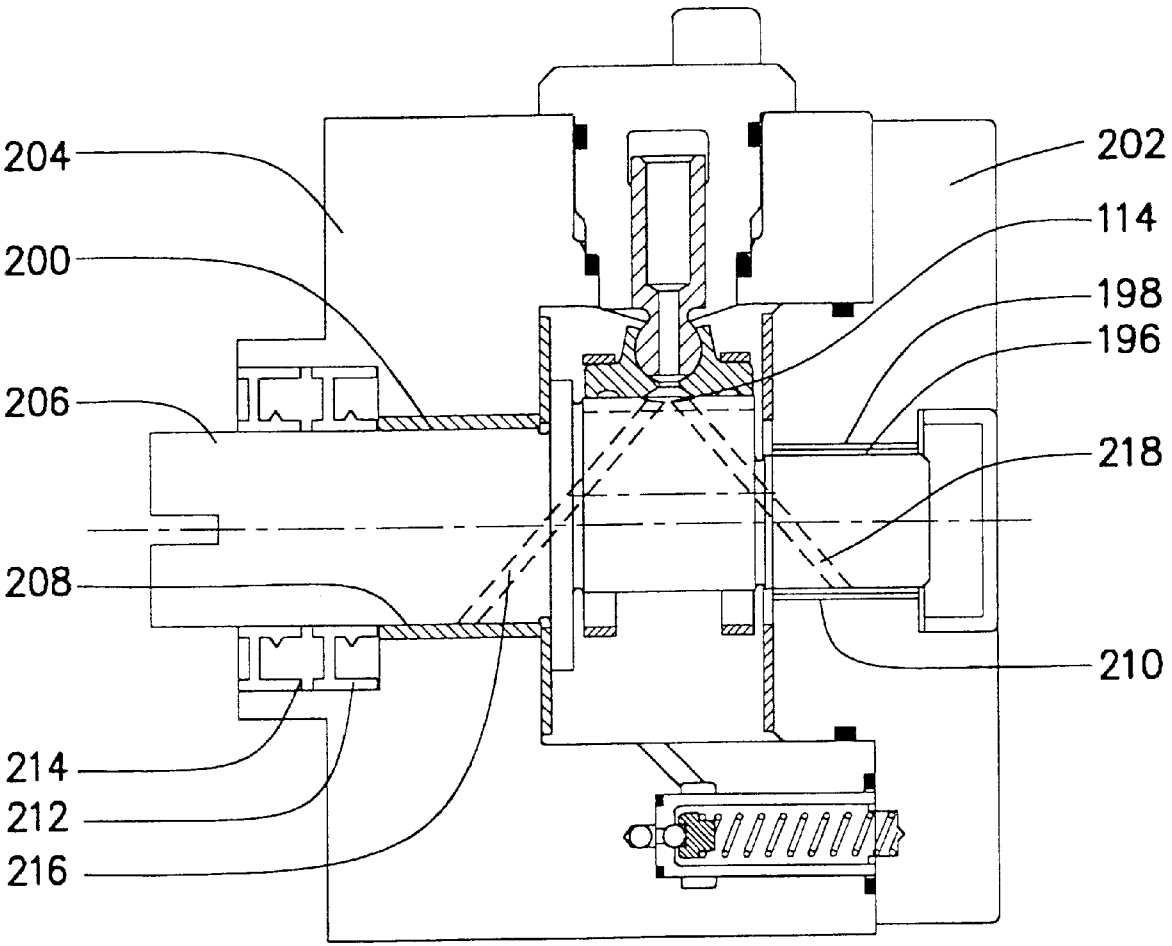
FIG. 14 is a schematic representation of an alternative shaft sealing embodiment relative to the embodiment of FIG. 2.

FIG. 14 shows an embodiment of the invention, which achieves both foreshortening, and leak protection. In this embodiment, the main drive shaft 206 has an extension 198, which is in front cover 202. The main shaft is situated in main bore 208, and the shaft extension 198 is situated in auxiliary bore 196. A wet bushing 200 is situated in the main bore 208, immediately adjacent the cavity. Similarly, an auxiliary wet bushing 210 is situated immediately adjacent the front side of the cavity. As can be appreciated, there is no danger of leakage through the front cover 202, because the cap for the auxiliary bore 196 can, in a well known manner, be readily at the terminus of the rotating shaft. On the other hand, the main shaft 206 must project from the back end of the pump for engagement with a gear, belt, or the like, and therefore cannot be sealed by a cap. Nevertheless, at the back end of the pump, in body 204, first and second seals 212,214 are provided in a chamber at the backside of wet bushing 200, to prevent fuel leakage at the back-end of the pump. The wet bushings provide a barrier to the longitudinal flow of fuel from the cavity along the respective shaft portions, but such seal is not necessarily complete. Nevertheless, the pressure acting on back seals 212,214, is considerably less than the pressure in the cavity. In order to prevent the pressure acting on the first and second seals 212,214, from exceeding a low value, for example, 0.5 bar, two balancing pressure passages 216,218 are provided, originating respectively from the surface of the main drive shaft 206 confronting the main wet bushing 200, and the surface of the auxiliary drive shaft or shaft extension 198, confronting the auxiliary wet bushing 210. These passages 216,218 are drilled obliquely through the drive shaft, terminating in a common opening on the exterior profile of the drive member, for registering with the shoe bores 114. Such registration occurs during the charging phase of operation of each plunger, when the pressure in the pumping chamber approaches a vacuum. As described above, this not only draws fuel into the pumping chamber from the cavity, but the low pressure also draws any potentially leaking fuel from the wet bushing into the pumping plunger. Therefore, in the embodiment having three plungers, the wet bushings are pressure balanced, three times per drive shaft revolution.

FIGS. 15–19 show yet another embodiment of the implementation of a charging technique whereby fuel at the feed pump pressure in the cavity, is delivered through a passageway in each plunger, to the respective pumping chambers. In this embodiment, fuel from the cavity is delivered through the shoes into the charging passageway of the plungers, but without separation of the shoes from sliding contact with the eccentric drive member. The charging arrangement 220 according to this embodiment, includes a slot 224 in the external profile of the drive member, which during rotation of the drive member, registers with the shoe bore during the charging phase of operation of each plunger, whereby fuel from the cavity enters the shoe bore and passes through the charging passage to the pumping chamber. The fuel inlet port in the cover is coaxially situated on the longitudinal axis of the pump, and a slot supply passage 226 is in fluid communication with the inlet port thereby assuring a full supply of feed fuel without necessitating channels or the like in the shoes.

As also shown in FIGS. 15–19, each shoe 228 has front and back ends 236,238, which are spaced apart in the axial direction, and two sides 240,242 which are spaced apart in the direction of rotation of the drive member. Each of these sides define a respective shoulder 244,246. The retention means in this embodiment includes two annular rigid retainer 222, each circumscribing the shoulders at the respective front and back ends of the shoes. The retainers have an angled cross section which also circumscribes the sides of all the shoes, whereby each shoe is captured and restrained from moving radially or axially relative to the other shoes.

As shown in FIG. 17, where FIG. 17(*a*) shows a reference starting position in which the base of the slot 224 is vertical and offset from the centerline of the vertically oriented plunger 44*a,* the start of the charging phase of operation occurs when the slot rotates counter-clockwise 5°. The charging phase continues and, as shown in FIG. 17(*b*) is well underway when the slot has rotated 60°. The shoe has pivoted on the inner end of the plunger 44*a* to assure continued registration of the shoe bore with the plunger discharge passage. Rotation continues past 120°, as shown in FIGS. 17(*c*) and (*d*). FIG. 17(*c*) shows that as the leading edge of the slot approaches the shoe bore of shoe 92(*b*), the trailing edge of the slot approaches the bore in shoe 92(*a*). The end of the charging phase of operation of plunger 44(*a*) occurs when the drive member has rotated 168°, which is intermediate the 120° rotation shown in FIG. 17(*c*) and the 180° rotation shown in FIG. 17(*d*). It can be appreciated that when the drive member is shown in cross section, the slot spans more than 120° of the circumference. Similarly, it can be appreciated that preferably, the charging phase of operation of a given plunger and associated pumping chamber 44(*b*), begins before the termination of the charging phase of operation of the immediately preceding plunger 44(*a*) and associated pumping chamber.

Figure 15:
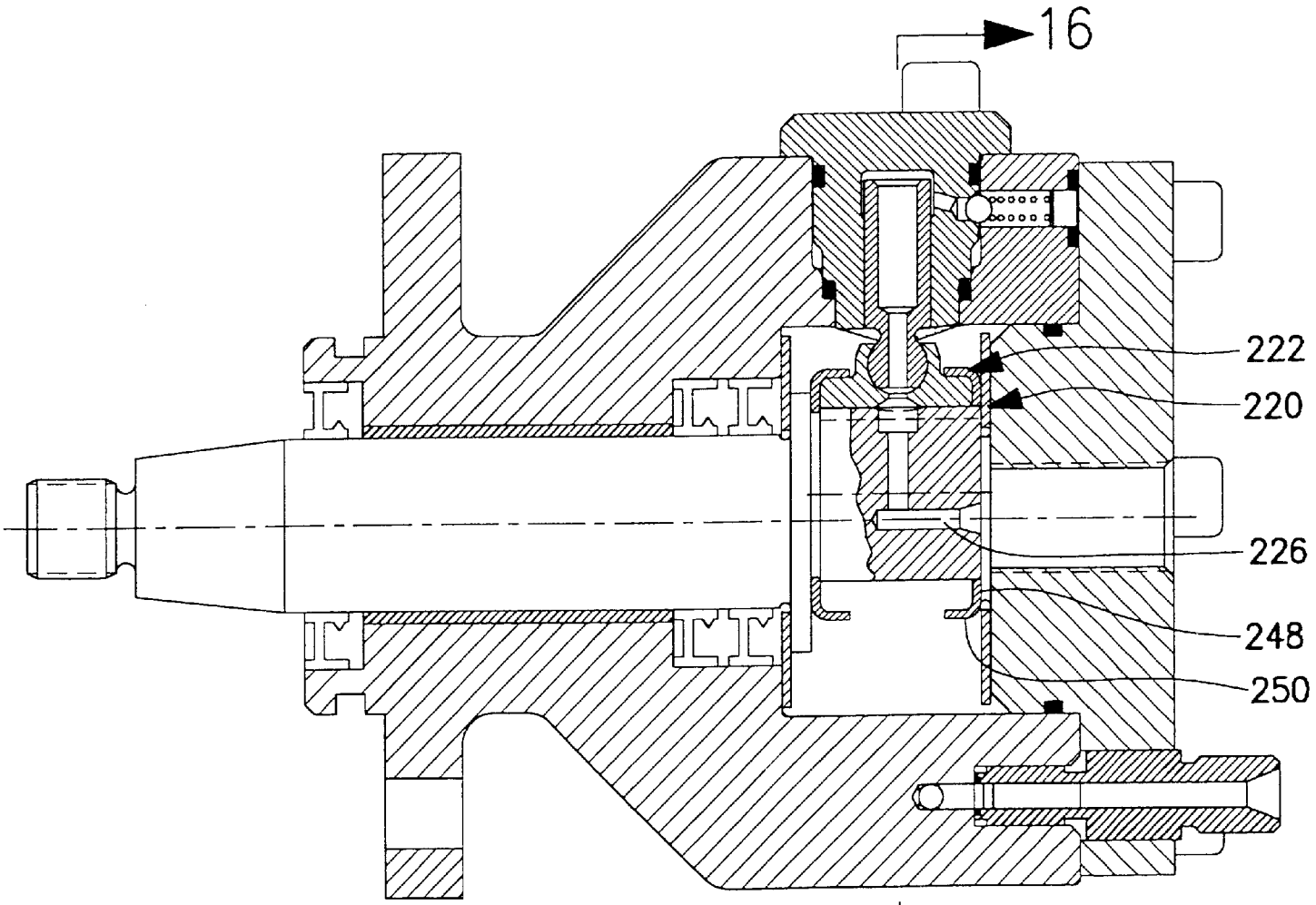
FIG. 15 is a longitudinal section view of a third embodiment of the pump shown in FIG. 3, whereby low pressure fuel is introduced to the inlet passageway of the pumping plunger, by means of a slot in the drive member.
Figure 16:
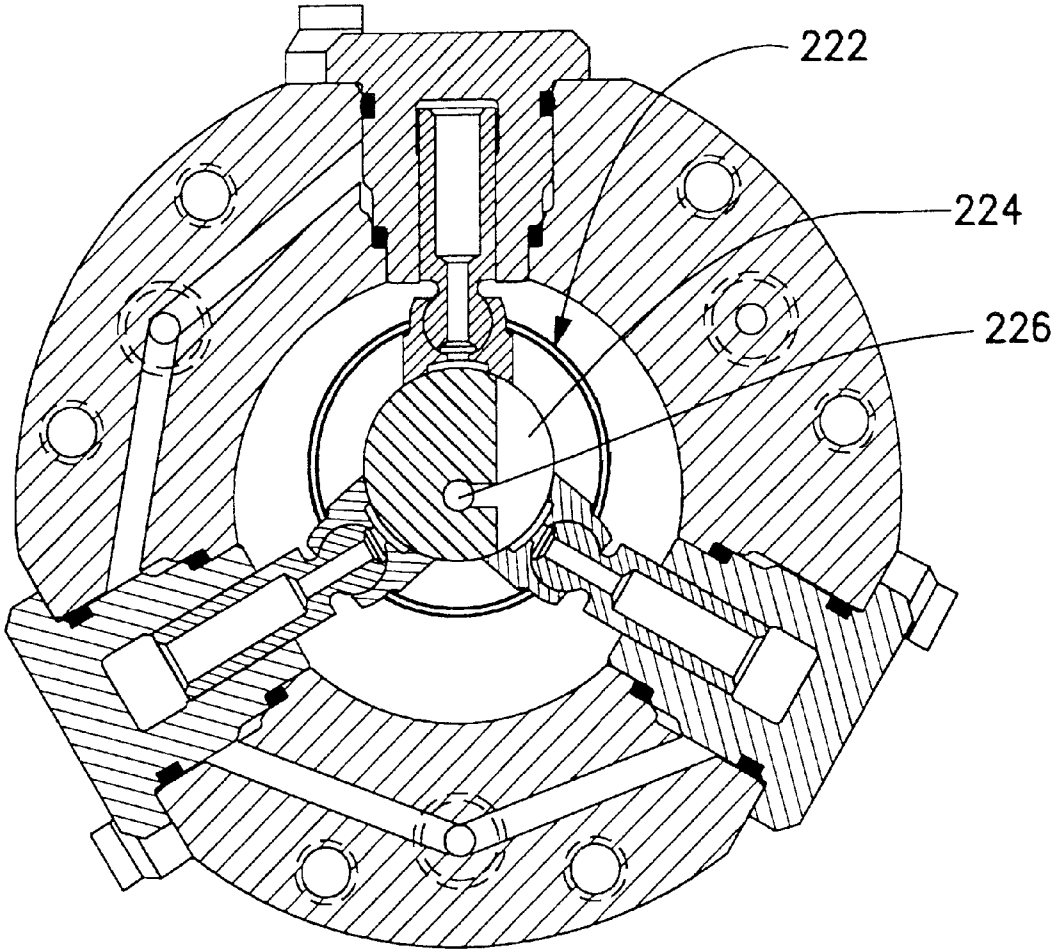
FIG. 16 is a cross-section view taken along line 16—16 of FIG. 15, also showing an alternative arrangement for retaining the shoes against the drive member.
Figure 17B:
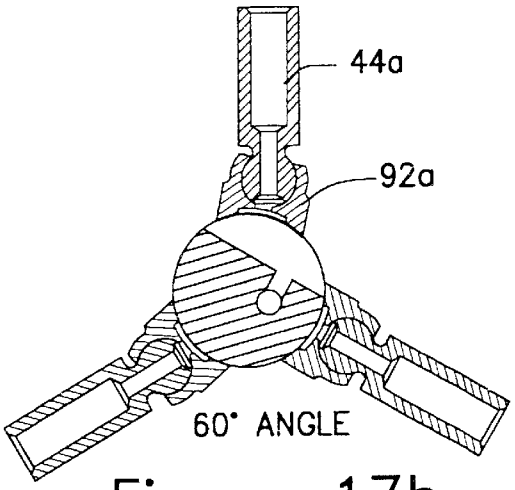
FIGS. 17(*a*)–(*d*) shows in detail, the relationship between the slot on the drive member and three plunger and shoe arrangements, during the charging phase of operation of one of the pumping chambers.
Figure 17D:
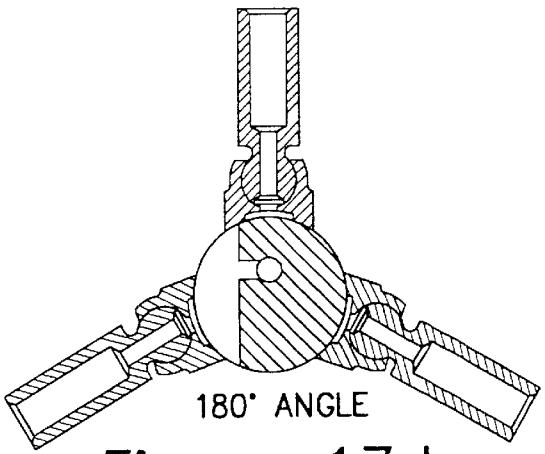
Figure 17A:
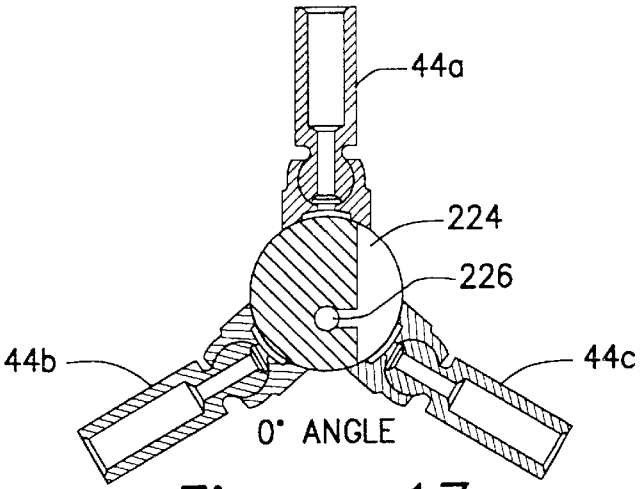
Figure 17C:
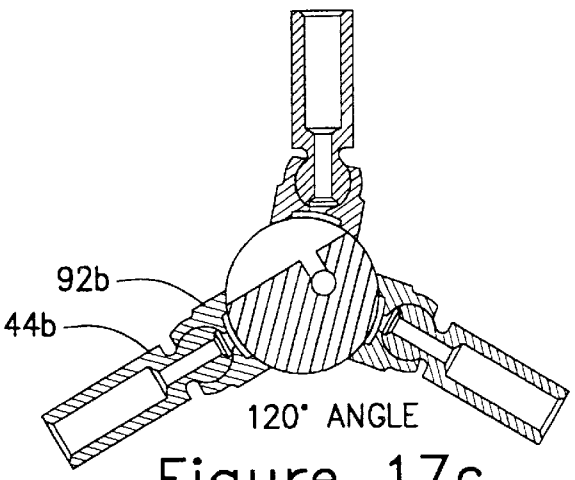
Figure 18:
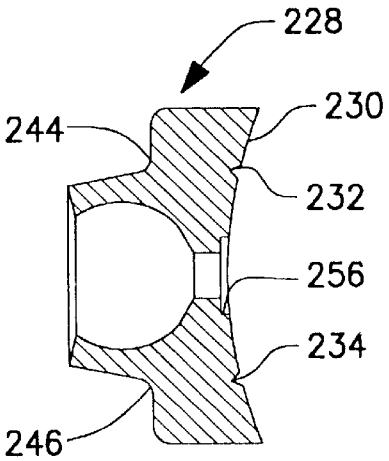
FIG. 18 is an enlarged view, in section, of one embodiment of the shoe member shown in FIG. 16.
Figure 19:
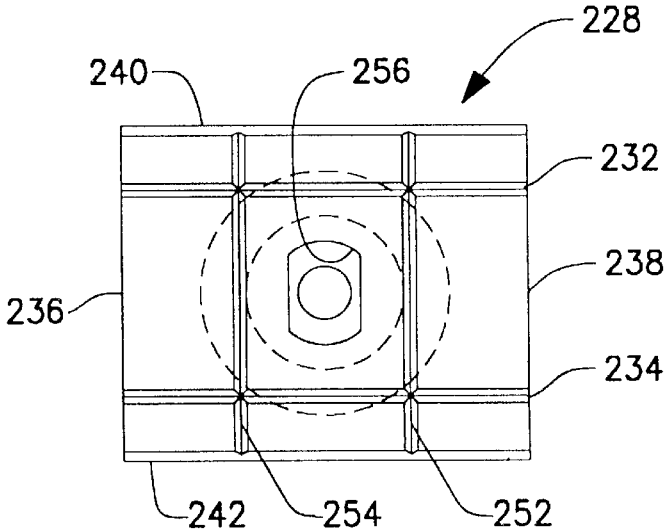
FIG. 19 is a plan view of the surface of the shoe of FIG. 18, which engages the drive member.

FIGS. 18 and 19 show additional details regarding the preferred features of the shoe 228 according to the embodiment of FIGS. 15 and 16. The shoe has an arcuate lower surface 230 which has two grooves 232,233 running between the shoe ends 236, 238, on either side of the shoe inlet port 256. Preferably, another set of grooves 252,254, run between the opposed sides 240,242 of the shoe. The inner section of the grooves define a frame within which the inlet port is centered. Although the entire lower surface 230 of the shoe is in contact with the exterior profile of the rotating drive member (due at least to the retaining effect of the annular retainers 222), the radially inward force resulting from the pumping phase of plunger operation, is imposed on the drive member, only within the area framed by the grooves. Depending on the orientation of the shoe during the drive shaft rotation, the minimum and maximum shoe loads can readily be tolerated without excessive wear.

Figure 20:
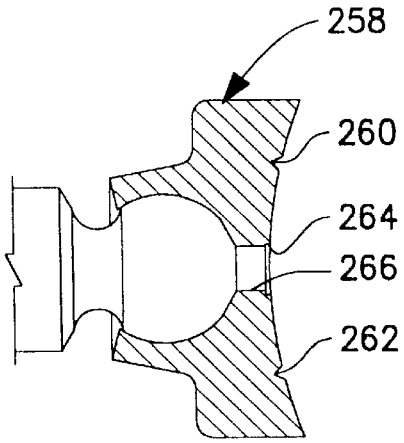
FIG. 20 is an alternative embodiment of the shoe depicted in FIG. 18.
Figure 21:
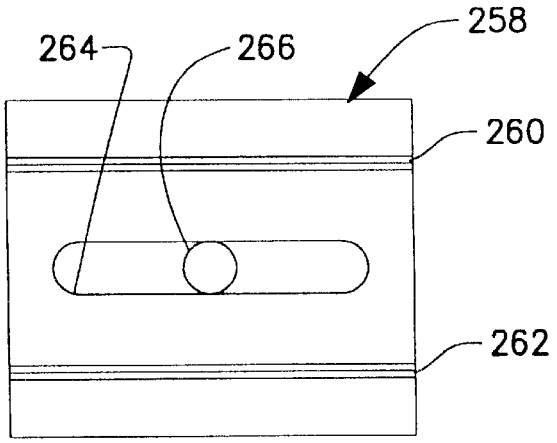
FIG. 21 is a plan view of the surface of the shoe of FIG. 20.

FIGS. 20 and 21 show an alternative arrangement to that described with respect to FIGS. 18 and 19. The general shape of the shoe 258 is similar, as are the grooves 260,262, and the shoe inlet passage 266. However, in this embodiment, the shoe inlet port 264 is elongated along a different direction than the elongation of the previously described embodiment. Thus, in the embodiment shown in FIG. 21, the inlet port is elongated in the direction of the pump axis, rather than in the direction of rotation of the drive member. Furthermore, only one pair of grooves is provided, which run in parallel with the elongation direction of the inlet port.

Figure 22:
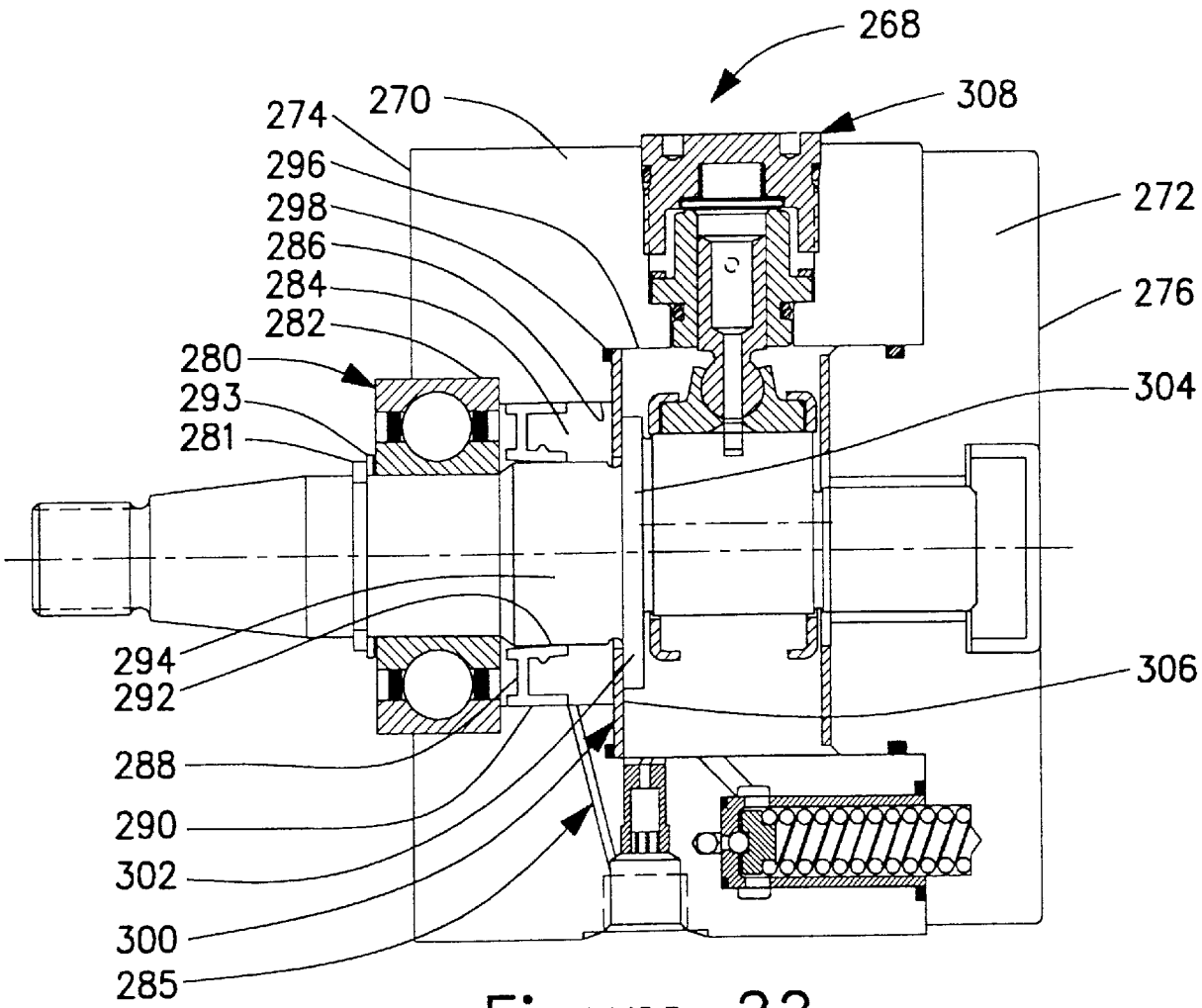
FIG. 22 is an alternative embodiment to the pump shown in FIG. 14, for implementing a seal along the drive chamber in a housing which has a relatively small axial dimension.

FIG. 22 depicts a longitudinal sectional view of another embodiment of the invention, in a pump housing which is relatively short in the direction of the axis of rotation of the drive member. In this embodiment 268, the pump has a body 270 and a cover 272, which define respective back and front ends 274,276. The drive shaft 278 extends through a throughbore in the body 270, into a blind bore in the cover 272, such that, as in the previously disclosed embodiments, the eccentric drive member is situated in a cavity formed between the body 270 and cover 272. The drive shaft 278 is supported in a roller bearing 280, which engages a backside pocket or the like defining a shoulder 282 in the body 270. A seal chamber 284 is defined internally, and in part by the roller bearing 280, the seal chamber wall 286, and a cylindrical portion 294 of the drive shaft. An annular seal 288 is situated therein, having a base 292 urged against the seal chamber wall 286, and a spring energized lip portion 292 which rides along the rotating cylindrical surface 294.

The body defines a front pocket with shoulder 296 on which is located an O-ring seal 298. An annular thrust plate 300 contacts the seal 298 at its outer portion, and the inner portion of the thrust plate rides in groove 302 situated adjacent the cylindrical surface 294 on shaft 278. The shaft includes a flange 304 which is in the cavity and contacts the inner portion of the thrust plate 300. This arrangement creates a virtual seal 306 whereby the fuel in the cavity is, as a practical matter, prevented from leaking toward the backside of the body 270. Nevertheless, because the seal chamber 284 is maintained at low pressure and is fluidly connected via passage 285 to the return line to the fuel tank (not shown), any fuel which does leak from the cavity into the chamber is returned to the fuel tank. The sealing arrangement shown in FIG. 22 is implemented during assembly while the cover 272 is off. The installer urges the drive shaft 278 to the left, thereby urging the flange 304 against the thrust plate 300 and energizing seal 298. This creates a slight gap between the roller bearing 280 and the bearing retaining flange 281. As a result, the installer can slip a wave washer 293 or the like in the gap, to urge the bearing 280 and shaft 278 in opposite axial directions. This takes up tolerances once the installer releases the axial force on the drive shaft. The flange 304 continues to contact the inner portion of thrust plate 300, with considerable overlap, thereby establishing the virtual seal 306 there between.

Figure 24:
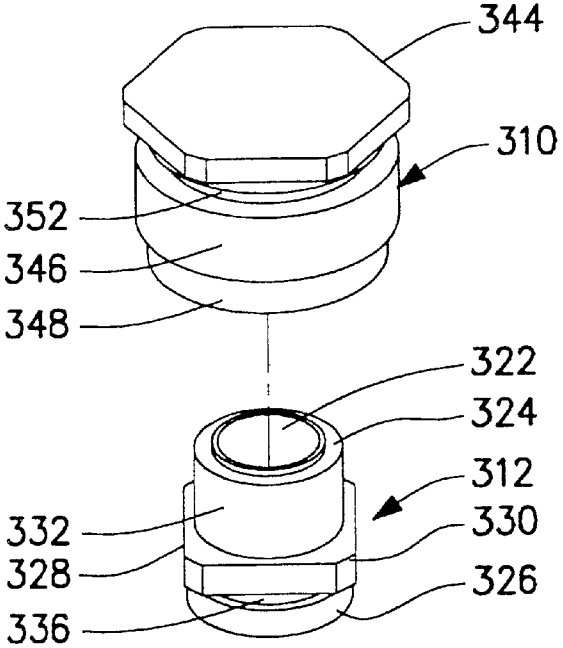
FIG. 24 is an exploded view of two components in perspective, illustrating how they can be nested together to form the plunger plug arrangement shown in FIG. 23.
Figure 23:
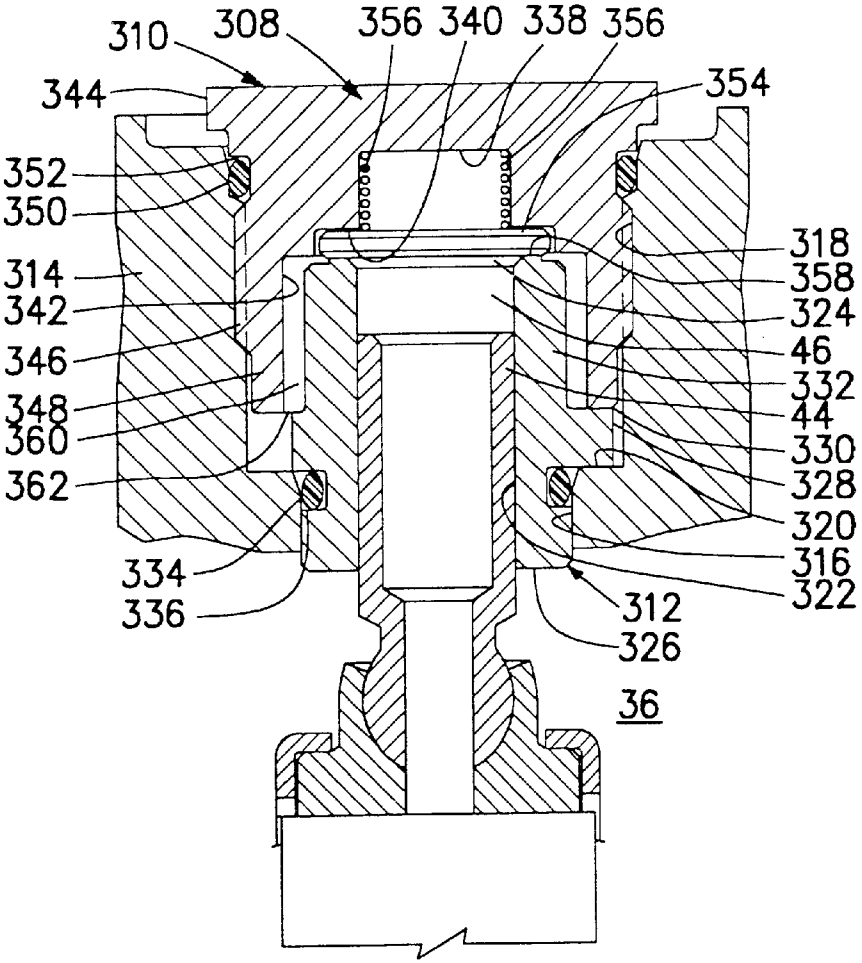
FIG. 23 is an enlarged view of a preferred plunger plug arrangement which is both easy to manufacture and easy to install.

FIG. 22 also shows an alternative plunger plug arrangement 308, which, of course, can be utilized with other embodiments of the pump housing and leak prevention techniques. Such alternative plunger plug 308 is described in greater detail in FIGS. 23 and 24. The plunger plug comprises two unitary pieces, a cap 310 and a plunger guide 312, which are secured in the pump body 314. The pump body has a primary through bore 316, which extends to the cavity 36. This primary through bore is counterbored and threaded as shown at 318. This forms an internal shoulder 320. Plunger guide 312 has a plunger through bore 322 which has an opening at the upper end 324, and a lower end or bottom 326 which preferably extends into the cavity 36. The plunger guide 312 has an external non-circular (e.g., polygonal) flange 328 intermediate the ends 324,326. The flange 328 defines a plurality of corners 330 which engage the internal e.g., annular shoulder 320, to limit the radially inward position of the plunger guide 312. An upper guide wall portion 332 extends upwardly from the flange 328, and an O-ring seal 334 is situated in a groove 336 below the flange, for engagement with the primary bore 316 of the pump body. The cap 310 has a primary, blind bore 338, a first counter bore 340 defining a shoulder, and a second counter bore 342. The upper exposed portion of the cap 310 is formed as a head 344 which can be engaged by any typical installation tool. The exterior side wall below the head 346 is threaded to engage the mating threads in the counter bore portion 318 of the pump body. The annular base portion 348 extends below the threaded portion and, because it is annular, it contacts the flange 328, only at the corners 330. A groove 352 is provided immediately below the head 344, to receive and energize an O-ring seal 350 against the bore in the body 270.

The primary bore 338 forms a pocket for receiving and seating biasing means such as a coil spring which urges a discharge check valve member 354 of preferably disc-like shape, against the valve seat 358 at the circumferential surface defining the opening at the upper end 324 of the plunger guide 312. The pumping chamber 46 is defined between the upper end of plunger 44 and the valve member 354. It can be appreciated that as the plunger is driven radially outwardly, the valve member 354 lifts and the fuel at high pressure enters the discharge passage 360 defined as a space or annulus between the upper guide wall 332 of the plunger guide and the second counter bore 342 of the cap 310. At the interface between the base 348 of the cap 310 and the flange 328 of the plunger guide 312, a plurality of gaps 362 exist between the corners of the flange. The fuel can pass through these gaps toward, e.g., the internal common rail such as 22 as shown in FIG. 1.

It can be appreciated by one familiar with machining techniques for parts of this nature, that each of the cap 310 and the plunger guide 312 can be machined from bar stock, with only a single chuck mounting. Moreover, the connection and mounting of the parts 310,312, to each other, with the discharge check valve, the body, and the plunger, can be easily made during assembly.

Figure 25:
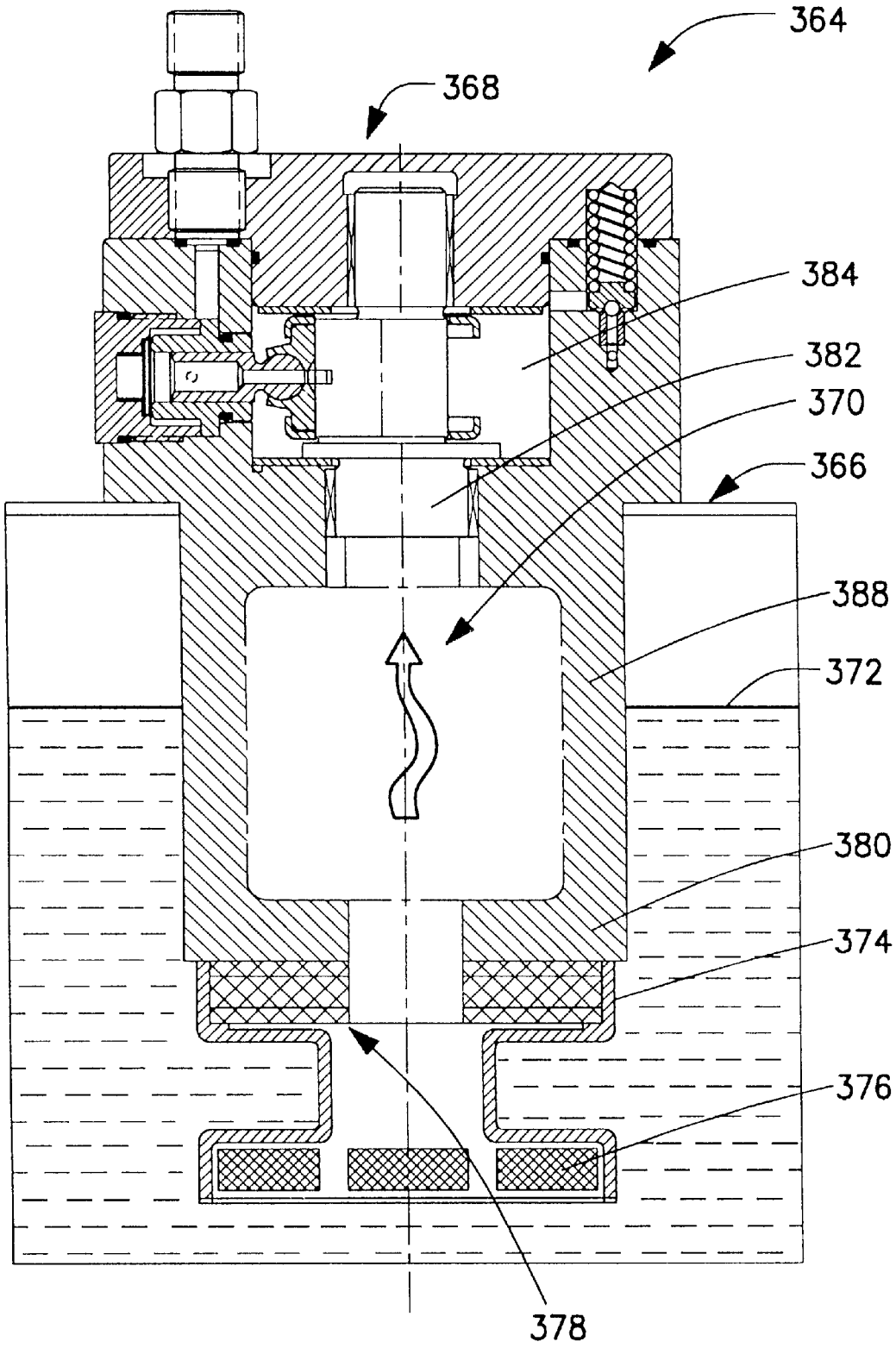
FIG. 25 shows another pump embodiment, where the pump body also forms a housing for an electric motor unit whereby the pump can be mounted on a fuel tank and draw fuel directly from the tank into the pump cavity.
Figure 27:
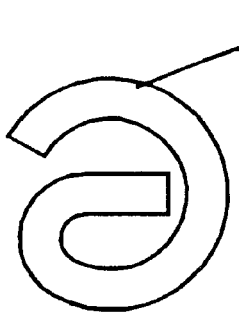
FIG. 27 is a plan view of the valve retention member of FIG. 26.

FIG. 25 shows yet another embodiment 364 of a high pressure gasoline supply pump 368, suitable for mounting onto a fuel tank carried by a vehicles rather than in the engine compartment. In this embodiment, the pump body 386 which forms a portion of the pump housing, also forms the housing 388 for an associated electric motor unit 370 for rotating the pump shaft 382,382'. Between these two portions of the shaft, the pump drive member is situated in cavity 384, in a manner similar to that described for other embodiments of the invention. In the illustrated embodiment, the motor shaft 380 is coaxial with the pump shaft 382,382'. The motor shaft can also drive a primary pump 378 located at the end of the motor opposite the high pressure pump 368. The electric motor unit 370 and fuel intake section 374 connection thereto, are supported inside the fuel tank 366, with the intake screen 376 of the intake section 374 near the bottom of the tank so it will always be below the normal fuel level 372. Fuel from the tank is drawn up through screen 376 into the primary pump 378, which delivers a flow of fuel through the electric motor 370, along shaft 382, into cavity 384. The fuel in cavity 384 is then drawn into the pumping plungers for pressurization in the pumping chambers, in a manner similar to that described above. Those familiar with this technology, can readily select conventional electric motor units 370 and associated intake sections 374, which have in the past been used with a conventional type of gasoline pump for fuel injection. Nevertheless, with applicant's invention, a high pressure common rail arrangement can be achieved in a very cost effective and energy efficient manner, because of the simplicity of providing fuel to the cavity with an electrical feed pump such as 378.

Moreover, in a variation of the embodiment shown in FIG. 25, a separate primary or feed pump 378 can, in some instances, be eliminated, because the vacuum induced by the movement of the plungers, due to rotation of the drive member by the electric motor 370, will draw fuel directly from the fuel tank into the cavity 384, and from the cavity into the plungers, according to the method described above. Particularly in such embodiment, it may be desirable to offset the electric motor shaft axis from the axis of the pump drive shaft 382, whereby reducing gears may be situated between these shafts, to provide the desired torque and/or speed for rotation of the drive member which actuates the plungers.

Figure 26:
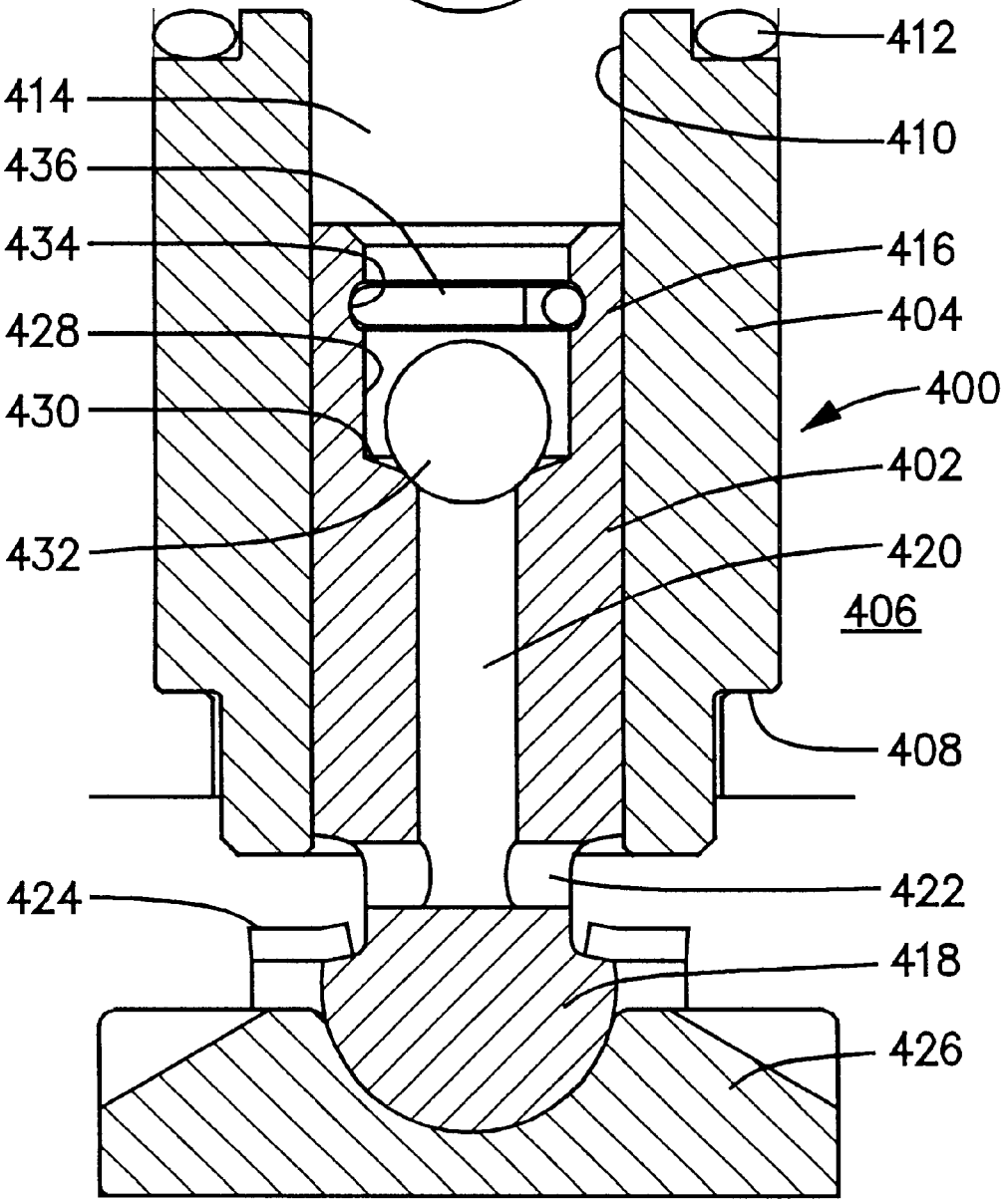
FIG. 26 is a section view similar to FIG. 10, of a variation of the fuel delivery passageway with charging check valve, having an associated valve retention member.

FIGS. 26–29 show two variations 400,450 of the embodiment shown in FIG. 10, whereby a spring or the like need not be provided for the charging check valve. In FIG. 26, the plunger 402 reciprocates within a guide 404 (analogous to guide 332 in the embodiment of FIG. 23). The guide 404 has an exterior shoulder 408 near the lower end, which engages an internal counter-shoulder or stop formed in a bore of housing 406. The cylinder bore 410 formed through guide 404 for reciprocation of the plunger 402, at least in part defines the pumping chamber 414. The upper end of the guide 404 including ring seal 412, can be covered and sealed in any convenient manner, based on, for example, the embodiment shown in FIGS. 10 and/or 23. It should be understood that the details of the pumping chamber 414 and associated discharge check valve and the like, are not shown but can be implemented based on the other embodiments which have been shown and described herein.

The plunger 402 has an upper end 416 which reciprocates within the bore 410 and a lower head end 418, preferably formed as a portion of a sphere. A charging passage 420 draws fuel from the cavity through ports or channels 422. In the illustrated embodiment, these inlet ports 422 are situated immediately above the spring-like retaining means 424, which retain the head portion 418 of the plunger in a seat or socket of the sliding shoe 426. The charging passage 420 leads to a valve cavity or chamber 428 of larger diameter. The transition between the charging passage 420 and the valve cavity 428 forms a seat 430 into which a ball valve member 432 can seal and thereby isolate the charging passage 420 from the high pressure generated in the pumping chamber 414 during the pumping phase of operation.

In a significant aspect of this variation 400, the valve cavity 428 at the upper end 416 of the plunger 402, includes valve stop or retention means 436, which serves two related functions. First, the valve stop means 436 assures that the valve ball 432 does not fall out of the cavity 428 during handling and assembly, and second, the stop means 436 positively limits the displacement of the valve 432 during the charging phase of operation. The stop means 436 should be located as close to the valve member 432 as will allow full opening of the valve for flow along seat 430, while limiting the displacement before the valve member 432 acquires significant momentum.

The valve stop member 436 in this embodiment is a substantially planar spring member, somewhat resembling the lower case letter "e", and is resilient in the radially inward and outward directions (relative to the piston axis). The member 436 can be formed from circular or other wire, thereby providing an arcuate outer surface which defines an unstressed diameter greater than that of the valve cavity 428. The valve cavity 428 includes grooves or other recesses 434, in this case, annular or substantially annular, such that the member 436 when forced through the open end of cavity 428 will compress radially until reaching the annular recess 434, where the member 436 will expand and in essence lock into place.

Figure 29:
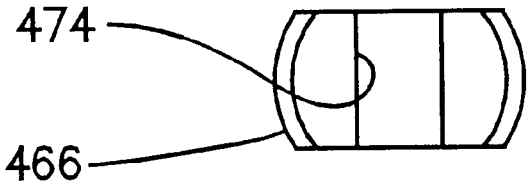
FIG. 29 is a top view of the valve retention member of FIG. 28.
Figure 28:
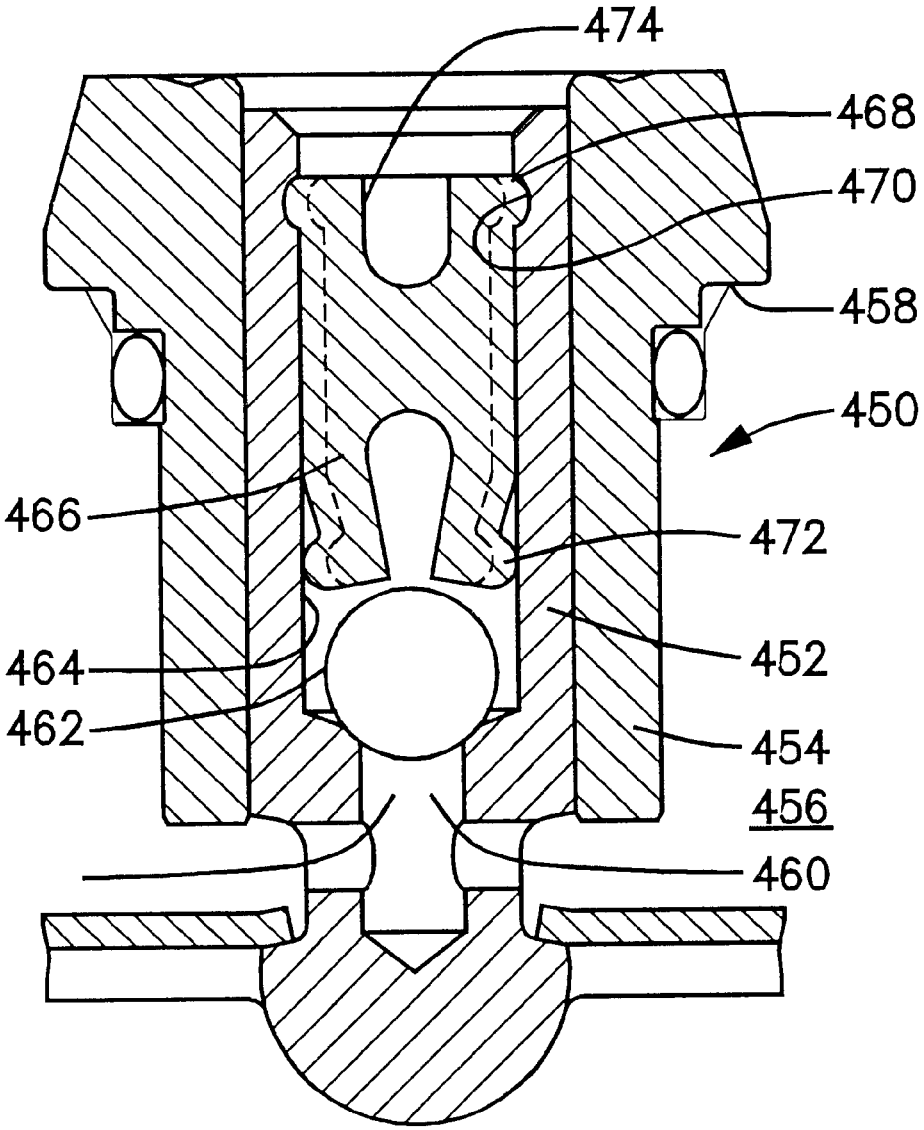
FIG. 28 is a view similar to FIG. 26, showing another variation of the fuel delivery passageway with charging check valve and associated valve retention member.

FIGS. 28 and 29 show the other variation 450, according to which the charging valve member 462 is situated nearer to the driven end of plunger 452, than to the pumping chamber. The plunger 452 is situated in a guide 454 which has an external shoulder 458 which rests on a counter-shoulder in housing 456. The charging passage 460 is considerably shorter than that depicted in FIG. 26, but the operation of the ball valve member 462 in relation thereto, is similar. In this embodiment, however, the valve cavity 464 occupies more than half the total length of the piston 452. An elongated ball retention or stop member 466 is insertible through the open end of the valve cavity 464, whereby external projections at the upper end 468 engage internal recess means 470 in the valve cavity portion 464 of plunger 452. The other end of the retaining member 466, is situated in closely spaced relation to the seated valve member 462.

Preferably, the retention member 466 is not circular when viewed from the top or in cross-section, but as shown in FIG. 29, is generally rectangular with the longer opposed sides being generally straight, and the shorter opposed sides having a radius of curvature approximately that of the valve chamber 464. The upper end of member 466, and preferably both ends, have the short sides projecting outwardly as shown at 468 and 472, whereas the regions of member 466 between these projections are hollow. This forms finger-like structures which are resilient in the radial direction. The recesses 470 need not be circumferential around the inside surface of the valve cavity 464, but rather are preferably slightly longer than the opposed arcuate sides of member 466. In this manner, member 466 can first be rotated 90° relative to the orientation shown in FIG. 28, then inserted through the open end of valve cavity 464 until the lower projecting end 472 passes the recesses 470, then rotated into the orientation shown in FIG. 28 and further inserted until the projections 468 snap into the recesses 470.

Notwithstanding that the retaining member 466 is elongated, once the member has been secured in place, the lower end 472 presses outwardly due to the radial preload, and therefore resists axial movement through the valve chamber 464. This also reduces the possibility of vibration or fretting, and also helps resist the contact of the valve member 462 during the charging and discharging cycles. The outward bias supplements the interference fit between the upper end 468 and the recess 470, which provides a positive stop against axial displacement.

It can be appreciated that the embodiments of FIGS. 26–29 provide a valve member retention means which is insertible through the open end of the valve cavity and self-retained therein, e.g., by an interference fit, preferably in the nature of a radially biased detent or the like, thereby providing a limit or stop surface in closely spaced relation from the axially displaceable charging valve member. Although for convenience, the charging passage and valve cavity can be considered as distinct regions joint at the valve seat, it should be understood that the valve cavity can also be considered as an enlarged region of the charging passage.

As noted previously, the embodiments described in FIGS. 10 and 26–29 provide for inlet flow to the charging passage within the plunger, directly from the cavity, without the need for porting and a flow channel through the sliding shoe in which the plunger is mounted. In those embodiments where the sliding shoe has an inlet port, for example, as shown in FIG. 19, the flow of fuel provides lubrication to the sliding surface. However, in the embodiments such as FIGS. 10 and 26–29 where an inlet path does not traverse the sliding shoe, parallel grooves on the sliding surface of the shoe, i.e., 260,262, as shown in FIG. 21 provide means for the fuel to enter and replenish the sliding surface and thereby enhance lubrication. This advantage is distinct from the effect of the intersecting groove pattern as shown in FIG. 19 in conjunction with an inlet port 256 for entry of fuel into the shoe passage, whereby such balancing groove pattern limits the maximum area of the underside of the shoe which is exposed to decaying high pressure, preventing shoe lifting during the pumping stroke and thereby reducing leakage.

What is claimed is:

1. A pump in a gasoline fuel supply system for supplying high pressure fuel to a common rail, comprising:

a pump housing having a longitudinal axis and a cavity coaxially disposed within the housing, wherein said housing is elongated and includes an electric motor situated therein, having a motor shaft;

a drive member rotatable by said motor shaft, situated in said cavity, and having an external profile which during one revolution of rotation defines a circle of rotation which is eccentric relative to said axis;

means for providing a source of gasoline fuel to said cavity wherein said means for supplying includes a fuel tank containing fuel at substantially ambient pressure, and a supply pump mounted on said tank whereby the housing with motor extends into the fuel tank for immersion in the fuel contained therein;

a plurality of plunger bores extending radially from the cavity and having radially outer and inner ends;

a plurality of pumping plungers situated for reciprocal radial movement in respective plunger bores, each plunger having radially outer and inner ends relative to said axis, and an internal charging passage which opens toward the cavity at the inner end of the plunger and opens toward said outer end of the plunger bore at the outer end of the plunger;

shoe means connected between the inner end of each plunger and the external profile of the drive member, for sliding on said external profile during rotation of said drive member and thereby actuating the reciprocal movement of said plungers in their respective plunger bores;

retention means, for urging said shoe means against the external profile of said drive member during rotation thereof;

a discharge passage from the outer end of each plunger bore into the housing, and a discharge check valve in said discharge passage for permitting flow only away from said plunger bore, all said discharge passages being fluidly connected to said common rail;

whereby reciprocation of each plunger includes movement toward an inner limit position for inducing a low pressure in the outer end of the pumping bore, thereby drawing fuel in a charging phase of operation from the cavity through said charging passage into the outer end of the pumping bore, and movement toward an outer limit position for developing a high pressure in the outer end of the pumping bore, thereby discharging fuel through said discharge check valve into said common rail in a discharging phase of operation.

2. The fuel supply pump of claim 1, wherein the charging phase of operation draws fuel from the fuel tank, through the motor, along the pump shaft, and into said cavity, without a feed pump.

3. The fuel supply pump of claim 1, wherein said means for providing a source of fuel maintains the cavity at a pressure in the range of about 2–5 bar.

4. A high pressure common rail gasoline fuel supply pump, comprising:

a housing having a longitudinal axis and a cavity coaxially disposed within the housing;

a rotatable drive member situated in said cavity and having an external profile, which during one revolution of rotation defines a circle of rotation which is eccentric relative to said axis;

means for maintaining said cavity filled with fuel at a pressure of at least 2 bar;

a plurality of plunger bores extending radially from the cavity and having radially outer and inner ends;

a plurality of pumping plungers situated for reciprocal radial movement in respective plunger bores, each plunger having radially outer and inner ends relative to said axis, and an internal charging passage which opens toward the cavity at the inner end of the plunger and opens toward said outer end of the plunger bore at the outer end of the plunger;

shoe means connected between the inner end of each plunger and the external profile of the drive member, for sliding on said external profile during rotation of said drive member and thereby actuating the reciprocal movement of said plungers in their respective plunger bores;

retention means, for urging said shoe means against the external profile of said drive member during rotation thereof;

a discharge passage from the outer end of each plunger bore into the housing, and a discharge check valve in said discharge passage for permitting flow only away from said plunger bore;

a common rail situated within the housing and fluidly connected to all said discharge passages, downstream of the discharge check valves;

whereby reciprocation of each plunger includes movement toward an inner limit position for inducing a low pressure in the outer end of the pumping bore, thereby drawing fuel in a charging phase of operation from the cavity through said charging passage into the outer end of the pumping bore, and movement toward an outer limit position for developing a high pressure in the outer end of the pumping bore, thereby discharging fuel through said discharge check valve into said common rail in a discharging phase of operation; and wherein said housing has front and back ends along said longitudinal axis and a drive shaft bore extending coaxially from the back end of the housing to the cavity;

a rotatable drive shaft is coaxially situated in the drive shaft bore, journalled therein by a semi-wet bushing means having front and back ends, and rigidly connected to said drive member in said cavity;

said drive shaft bore includes a front seal chamber interposed between and in fluid communication with the cavity and the front end of the bushing, and a back seal chamber interposed between and in fluid communication with the back end of the bushing and an ambient pressure condition;

high pressure seal means are provided in the front seal chamber, for sealing against flow of fuel in the cavity through the drive shaft bore; and low pressure seal means are provided in the back seal chamber, for preventing any fuel flow which might leak through the high pressure seal and through the semi-wet bushing bore to the back end of the bushing, from leaking out of the back of the housing.

5. The fuel supply pump of claim 4, wherein the fuel supply pump is fluidly connected to a low pressure fuel tank, and said pump includes a leak return passage running through said housing, from the back seal chamber to a low pressure relief valve in the housing, said relief valve being fluidly connected to the tank for returning leaking fuel from the back seal chamber to said tank.

6. A high pressure common rail gasoline fuel supply pump, comprising:

a housing having a longitudinal axis and a cavity coaxially disposed within the housing;

a rotatable drive member situated in said cavity and having an external profile, which during one revolution of rotation defines a circle of rotation which is eccentric relative to said axis;

means for maintaining said cavity filled with fuel at a pressure of at least 2 bar;

a plurality of plunger bores extending radially from the cavity and having radially outer and inner ends;

a plurality of pumping plungers situated for reciprocal radial movement in respective plunger bores, each plunger having radially outer and inner ends relative to said axis, and an internal charging passage which opens toward the cavity at the inner end of the plunger and opens toward said outer end of the plunger bore at the outer end of the plunger;

shoe means connected between the inner end of each plunger and the external profile of the drive member, for sliding on said external profile during rotation of said drive member and thereby actuating the reciprocal movement of said plungers in their respective plunger bores;

retention means, for urging said shoe means against the external profile of said drive member during rotation thereof;

a discharge passage from the outer end of each plunger bore into the housing, and a discharge check valve in said discharge passage for permitting flow only away from said plunger bore;

a common rail situated within the housing and fluidly connected to all said discharge passages, downstream of the discharge check valves;

whereby reciprocation of each plunger includes movement toward an inner limit position for inducing a low pressure in the outer end of the pumping bore, thereby drawing fuel in a charging phase of operation from the cavity through said charging passage into the outer end of the pumping bore, and movement toward an outer limit position for developing a high pressure in the outer end of the pumping bore, thereby discharging fuel through said discharge check valve into said common rail in a discharging phase of operation; and a rail pressure regulator in the housing, having a high pressure side in fluid communication with the rail, a low pressure side in communication with the cavity, and a spring-loaded valve separating the high pressure side from the low pressure side.

7. The fuel supply pump of claim 6, wherein the front end of the housing comprises a selectively detachable housing cover, and said rail pressure regulator is situated at least in part, in said housing cover.

8. The fuel supply pump of claim 6, wherein said pressure regulator comprises, a control piston chamber having a control end and an opposite controlled end;

a control piston situated for displacement within the control piston chamber, and having a respective control end and a controlled end;

means for biasing the control piston toward the controlled end of the control piston chamber;

a valve seat at the control end of the control piston chamber;

a valve member interposed between the controlled end of the control chamber and the controlled end of the control piston, said valve member being subjected to a seating load against said seat in response to the displacement of the control piston;

means for exposing the valve seat to rail pressure;

means for exposing the control end of the piston to rail pressure through a flow restrictor;

means for exposing the controlled end of the piston chamber to cavity pressure;

means for exposing the control end of the piston to cavity pressure, through a modulated control valve.

9. The supply pump of claim 8, wherein the modulated valve is a proportional solenoid valve, which is displaceable in response to rail pressure change demand signal.

10. A high pressure common rail gasoline fuel supply pump, comprising:

a housing having a longitudinal axis and a cavity coaxially disposed within the housing;

a rotatable drive member situated in said cavity and having an external profile, which during one revolution of rotation defines a circle of rotation which is eccentric relative to said axis;

means for maintaining said cavity filled with fuel at a pressure of at least 2 bar;

a plurality of plunger bores extending radially from the cavity and having radially outer and inner ends;

a plurality of pumping plungers situated for reciprocal radial movement in respective plunger bores, each plunger having radially outer and inner ends relative to said axis, and an internal charging passage which opens toward the cavity at the inner end of the plunger and opens toward said outer end of the plunger bore at the outer end of the plunger;

shoe means connected between the inner end of each plunger and the external profile of the drive member, for sliding on said external profile during rotation of said drive member and thereby actuating the reciprocal movement of said plungers in their respective plunger bores;

retention means, for urging said shoe means against the external profile of said drive member during rotation thereof;

a discharge passage from the outer end of each plunger bore into the housing, and a discharge check valve in said discharge passage for permitting flow only away from said plunger bore;

a common rail situated within the housing and fluidly connected to all said discharge passages, downstream of the discharge check valves;

whereby reciprocation of each plunger includes movement toward an inner limit position for inducing a low pressure in the outer end of the pumping bore, thereby drawing fuel in a charging phase of operation from the cavity through said charging passage into the outer end of the pumping bore, and movement toward an outer limit position for developing a high pressure in the outer end of the pumping bore, thereby discharging fuel through said discharge check valve into said common rail in a discharging phase of operation; and wherein said housing has front and back ends along said longitudinal axis, the front end being defined by a cover which is selectively detachable from the housing;

a drive shaft main bore extends coaxially through the back end of the housing to the cavity, and a drive shaft auxiliary bore extends from said cavity into the housing cover;

a rotatable drive shaft is coaxially disposed through the back end of the housing to the cover and is rigidly connected to the drive member, the drive shaft being journalled in the main bore by a first wet bushing interior and in the auxiliary bore by a second wet bushing interior;

said drive shaft main bore includes seal means bearing on the shaft at the back end of the housing, adjacent said first wet bushing, to prevent fuel from leaking past the wet bushing and out of the back end of the housing; and means fluidly connect the interior of the first wet bushing to the interior of the second wet bushing, to balance any pressure difference therebetween.

11. The fuel supply pump of claim 10, wherein said means fluidly connecting the interiors intersect on the external profile of the drive member in registry with the shoe means.

12. A high pressure common rail supply pump comprising:

a housing having a substantially cylindrical cavity disposed therein and defining a longitudinal axis;

a drive shaft penetrating the housing;

a drive member rigidly extending longitudinally from the drive shaft and situated in said cavity asymmetrically relative to said longitudinal axis, whereby rotation of said shaft produces an eccentric rotation of the drive member relative to said axis, wherein said drive member has an external profile which during the eccentric rotation defines a circle of rotation;

a feed pump for delivering fuel to said cavity;

a plurality of equiangularly spaced plunger bores extending radially relative to the axis, from the cavity into the housing and having radially outer and inner ends;

a pumping plunger having radially outer and inner ends relative to said axis, and situated for reciprocal radial movement in a respective plunger bore, said plunger including an internal charging passage which opens to the cavity at the inner end of the plunger and opens to said outer end of the plunger bore at the outer end of the plunger;

shoe means pivotally connected between the inner end of each plunger and the external profile of the drive member, whereby said shoe means slide on said external profile during rotation of said drive member and thereby actuate the reciprocal movement of said plungers in their respective plunger bores;

retention means spanning all said shoe means, for urging said shoe means against the external profile of said drive member during rotation thereof;

a discharge passage from the outer end of each plunger bore into the housing, and a discharge check valve in said discharge passage for permitting flow only away from said plunger bore;

a common rail situated within the housing and fluidly connected to all said discharge passages, downstream of the discharge check valves;

whereby reciprocation of each plunger includes movement toward an inner limit position during which a low pressure develops in the outer end of the pumping bores, thereby drawing gasoline in a charging phase of operation from the cavity through said charging passage in the pumping plunger into the outer end of the pumping bore, and movement toward an outer limit position in a discharging phase of operation during which gasoline is discharged through said discharge check valve into said common rail.

13. The supply pump of claim 12, wherein the shoe means includes a shoe bore extending from the opening of the charging passage at the inner end of the plunger, to the outer profile of the drive member, whereby during the pumping phase of operation the shoe bore is sealed to the passage of fuel there through, by intimate contact of the shoe means with the drive member; and the retention means urges each of said shoe means toward the external profile with a retention force which permits momentary separation of each shoe in sequence from the exterior profile of the drive member, during the charging phase of operation of each plunger, whereby fuel from the cavity enters the shoe bore and passes through the charging passage to the outer end of the plunger bore.

14. The supply pump of claim 12, wherein, the shoe means includes a shoe bore extending from the opening of the charging passage at the inner end of the plunger, to the outer profile of the drive member, whereby during the pumping phase of operation the shoe bore is sealed to the passage of fuel there through, by intimate contact of the shoe means with the drive member; and the drive member external profile includes a slot which during rotation of the drive member, registers with the shoe means during the charging phase of operation of each plunger, whereby fuel from the cavity enters the shoe bore and passes through the charging passage to the outer end of the plunger bore.

15. The fuel supply pump of claim 12, wherein the feed pump delivers gasoline to said housing cavity at a pressure which maintains the gasoline in the cavity at a pressure of at least about 2 bar.

16. The fuel supply pump of claim 14, wherein the drive member is circular in cross section, and each shoe has an arcuate lower surface with a substantially uniform radius of curvature for intimately conforming to the exterior profile of the drive member, and at least one groove spanning said lower surface.

17. The fuel supply pump of claim 16, wherein said shoe bore defines an inlet port at said lower surface, said inlet port being elongated along the direction of rotation of the drive member.

18. The fuel supply pump of claim 17, wherein the at least one groove comprises a first set of two grooves each flanking the inlet bore and extending along the direction of rotation of the drive member and a second set of two grooves each flanking the inlet bore and extending transversely to and intersecting the first set of grooves, whereby said inlet port is framed by grooves.

19. The fuel supply pump of claim 16, wherein said shoe bore defines an inlet port at said lower surface, said inlet port being elongated along said longitudinal axis.

20. The fuel supply pump of claim 19, wherein the plunger has a cross sectional area in the plunger bore, which is greater than the area of said shoe inlet port.

21. The fuel supply pump of claim 14, wherein each shoe has two ends which are spaced apart in the direction of said axis, and two sides which are spaced apart in the direction of rotation of the drive member, each of said sides defining a shoulder, and said retention means includes a generally arcuate retainer segment extending respectively from each shoulder of each shoe to a shoulder of each adjacent shoe, the segments having an angled cross section which cradles the sides of the shoes, whereby each shoe is captured and restrained from moving radially or axially relative to the other shoes.

22. The fuel supply pump of claim 12, wherein, the opening of the charging passage in the plunger is located radially outward of the shoe means and is always exposed to the fuel in the cavity; and the charging passage includes a charging check valve which is normally closed against the fuel pressure at said open lower end, but which opens only to permit flow from the inner to the outer end of the plunger during said charging phase of operation.

23. The fuel supply pump of claim 22, wherein the drive member is circular in cross section, and each shoe has an arcuate lower surface with a substantially uniform radius of curvature for intimately conforming to the exterior profile of the drive member, and at least one groove spanning said lower surface.

24. The fuel supply pump of claim 23, wherein said at least one groove comprises two spaced apart grooves spanning the lower surface substantially parallel to said axis.

25. The fuel supply pump of claim 22, wherein each shoe has two ends which are spaced apart in the direction of said axis, and two sides which are spaced apart in the direction of rotation of the drive member, each of said sides defining a shoulder, and said retention means includes a generally arcuate retainer segment extending respectively from each shoulder of each shoe to a shoulder of each adjacent shoe, the segments having an angled cross section which cradles the sides of the shoes, whereby each shoe is captured and restrained from moving radially or axially relative to the other shoes.

26. The fuel supply pump of claim 22, wherein the plunger has a lower end in fluid communication with the cavity, an upper end defining in part the pumping chamber, and a valve chamber extending from the upper end and joined in fluid communication with the charging passage;

a valve member seated at the juncture of the valve chamber and charging passage; and a valve retention element self-retained in the valve chamber in fixed, spaced relation from the valve member when the valve member is seated.

27. The fuel supply pump of claim 26, wherein the valve retention element is resilient in a direction transverse to the valve chamber and is fixed thereto by interference engagement.

28. The fuel supply pump of claim 27, wherein the interference engagement includes at least one recess formed in the valve chamber.

29. The fuel supply pump of claim 28, wherein the valve retention member is a substantially planar coil spring.

30. The fuel supply pump of claim 28, wherein the valve retention member is an elongated element having hollow end portions, and lateral projections at the end portions for engaging mating recesses in the valve chamber.

31. In a high pressure gasoline fuel supply pump having a housing, a cavity within the housing filled with fuel at a feed pressure, a drive shaft penetrating the housing from one end thereof for rotating a drive member situated in the cavity to raise the fuel to a higher pressure than said feed pressure, a fuel return line maintained at a lower pressure than said feed pressure, and a bearing at said one end of the pump for rotationally supporting the shaft, a seal arrangement to prevent leakage of fuel from the cavity through the bearing, comprising:

a seal chamber formed between the housing and the cavity and bounded radially by the shaft and the housing;

a stationary annular plate mounted around the shaft and having radially outer and inner portions, and defining a cavity side forming a boundary of the cavity and a chamber side forming a boundary of the seal chamber;

a flange on the shaft and rotatable therewith in the cavity, said flange contacting the inner portion of the cavity side of the plate;

the housing having a shoulder overlapping the chamber side of the outer portion of the plate;

first seal means interposed between the outer portion of the plate and housing shoulder;

second seal means situated in the seal chamber and compressed between the housing and the shaft;

means carried by the shaft, for urging the shaft and bearing in opposite axial directions, whereby said flange is urged against said plate to form a virtual seal against the flow of fuel from the cavity to the seal chamber; and means for fluidly connecting the seal chamber with the low pressure fuel return line.

32. The arrangement of claim 31, wherein said means for urging the shaft, is interposed between a second flange on the shaft outside said one end of the housing, and a portion of the bearing outside said one end of the housing.

33. The arrangement of claim 32, wherein said means for urging the shaft, is a wave washer.

34. In a high pressure fuel supply pump having a body and a threaded bore in the body for receiving a plunger plug adapted to guide a pumping plunger for reciprocation therein along the axis of the bore, said bore having an inner end terminating within the pump and an outer end accessible from outside the pump, the plunger plug arrangement comprising:

a substantially cylindrical cap member having outer and inner ends, a blind primary bore, a first coaxial counterbore, and a second coaxial counterbore such that the primary bore terminates against a solid head portion at the outer end of the cap and the second counterbore is open at the inner end of the cap, said inner end of the cap forming an annulus defined by minor and major radii and facing the inner end of the body bore, said cap having an exterior threaded sidewall between the head and the inner end, for engaging the threads in the body bore;

a substantially cylindrical plunger guide member having inner and outer ends, the outer end sized to be received within and spaced from the second counterbore of the cap member, a through bore for receiving and guiding the plunger and defining an opening at the outer end and an opening at the inner end, and a non-circular external flange intermediate the ends, the flange having first external portions which extend radially a distance greater than said minor radius of the cap member and second external portions which extend radially a distance less than said minor radius;

a valve member mounted in the first counterbore of the cap and influenced by biasing means seated in the primary bore, toward the upper end of the guide member for selectively closing the opening at the upper end thereof; and shoulder means in the body bore, for supporting the flange on the guide member, against inward movement;

whereby a flow passage is defined from said valve member, through said space, and through a gap between said second portion of the flange and said inner end of the cap.

35. The arrangement of claim 34, wherein an outer annular seal is provided between the cap member and the body bore intermediate the external threads and the head, and an inner annular seal is provided between the guide member and the body bore, inwardly of the flange on the guide member.

36. The arrangement of claim 34, wherein the body includes a discharge passage which is fluid communication with said flow passage.

37. The supply pump of claim 22, wherein the shoe means includes a shoe bore extending from the opening of the charging passage at the inner end of the plunger, to the outer profile of the drive member, whereby during the pumping phase of operation the shoe bore is sealed to the passage of fuel there through, by intimate contact of the shoe means with the drive member; and the retention means urges each of said shoe means toward the external profile with a retention force which permits momentary separation of each shoe in sequence from the exterior profile of the drive member, during the charging phase of operation of each plunger.

38. The fuel supply pump of claim 37, wherein the drive member is circular in cross section, and each shoe has an arcuate lower surface with a substantially uniform radius of curvature for intimately conforming to the exterior profile of the drive member, and at least one groove spanning said lower surface.

39. The fuel supply pump of claim 38, wherein said at least one groove comprises two spaced apart grooves spanning the lower surface substantially in parallel.

* * * * *